US012622480B2

(12) United States Patent
Vanhoutin et al.

(10) Patent No.: US 12,622,480 B2
(45) Date of Patent: May 12, 2026

(54) HELMET WITH CUSTOM-FIT LINER

(71) Applicant: SCHUTT SPORTS IP, LLC, Litchfield, IL (US)

(72) Inventors: Louis Anthony Vanhoutin, Iuka, IL (US); Vincent R. Long, St. Peters, MO (US); Nathan Loucks, Litchfield, IL (US); Richard Groff, III, Litchfield, IL (US)

(73) Assignee: SCHUTT SPORTS IP, LLC, Litchfield, IL (US)

( * ) Notice: Subject to any disclaimer, the term of this patent is extended or adjusted under 35 U.S.C. 154(b) by 0 days.

(21) Appl. No.: 19/069,035

(22) Filed: Mar. 3, 2025

(65) Prior Publication Data

US 2025/0194729 A1 Jun. 19, 2025

Related U.S. Application Data

(63) Continuation of application No. 18/648,229, filed on Apr. 26, 2024, now Pat. No. 12,239,180, which is a (Continued)

(51) Int. Cl.
*A42B 3/12* (2006.01)
*A42B 3/20* (2006.01)

(52) U.S. Cl.
CPC ..... *A42B 3/127* (2013.01); *A42B 3/122* (2013.01); *A42B 3/128* (2013.01); *A42B 3/20* (2013.01)

(58) Field of Classification Search
CPC ..... A42B 3/127; A42B 3/124; A42B 3/128; A42B 3/125; A42B 3/12
See application file for complete search history.

(56) References Cited

U.S. PATENT DOCUMENTS 3,248,738 A * 5/1966 Morgan ..... A41D 13/015 2/455
3,673,609 A * 7/1972 De Simone ..... A42B 3/127 2/414

(Continued)

FOREIGN PATENT DOCUMENTS

GB 2340381 A 2/2000
GB 2398476 A 8/2004

OTHER PUBLICATIONS

Schutt Sports, "Schutt F7 Helmet Video", web. YouTube, Jul. 7, 2017, https://www.youtube.com/watch?v=1haHv2ptcGw (Year: 2017).*

(Continued)

*Primary Examiner* — Jillian K Pierorazio
(74) *Attorney, Agent, or Firm* — Ingrassia Fisher & Lorenz, LLP

(57) ABSTRACT

A sports helmet kit has a shell, attachable face guard, composite helmet liner, and fit pods to improve and customize the fit of the helmet to the wearer. The composite liner consists of a base liner and a selected group of fit elements, for example, fit pods, removably attached to the inner surface of the base liner (i.e., the surface of the base liner facing the wearer's head). The fit pods are selected from a set of fit pods having different properties, for example, different sizes, thicknesses, densities, and cross-sections. The selection of fit pods from the set may be aided by taking anatomical measurements of the wearer's head and analyzing the measurements with respect to the geometry of the helmet to produce a pressure map. The measurements may be taken by physical contact or by non-contact means. The fit pods may be selected to optimize a pressure map, and thus optimize the fit, for a given wearer of the helmet.

20 Claims, 18 Drawing Sheets

Related U.S. Application Data continuation of application No. 17/340,907, filed on Jun. 7, 2021, now Pat. No. 12,004,586, which is a continuation of application No. 16/815,861, filed on Mar. 11, 2020, now Pat. No. 11,026,466.

(60) Provisional application No. 62/836,923, filed on Apr. 22, 2019.

(56) References Cited

U.S. PATENT DOCUMENTS 3,729,744 A * 5/1973 Rappleyea ..... A42B 3/28 2/420
3,843,970 A * 10/1974 Marietta ..... A42B 3/127 2/415
4,432,099 A 2/1984 Grick et al.
4,788,972 A * 12/1988 DeBusk ..... A61F 5/058 602/5
5,083,320 A 1/1992 Halstead
5,603,117 A * 2/1997 Hudner, Jr. ..... A42B 3/127 2/6.6
5,846,063 A 12/1998 Lakic
6,226,801 B1 5/2001 Alexander et al.
6,490,737 B1 12/2002 Mazzei et al.
7,234,812 B2 6/2007 Piorkowski et al.
7,328,462 B1 2/2008 Straus
7,765,622 B2 * 8/2010 Wiles ..... A42B 3/127 2/6.6
7,870,617 B2 1/2011 Butler
8,001,622 B1 8/2011 Culley et al.
8,055,122 B2 11/2011 Yahata
8,069,498 B2 12/2011 Maddux et al.
8,347,419 B1 1/2013 Cleva
8,505,122 B1 * 8/2013 Green ..... A41D 13/0156 2/463
8,566,969 B2 * 10/2013 Glogowski ..... A42B 3/122 2/414
9,131,744 B2 * 9/2015 Erb ..... A42B 3/125
9,462,842 B2 10/2016 Hoshizaki et al.
9,545,127 B1 * 1/2017 Sandifer ..... A42B 3/121
9,622,533 B2 4/2017 Warmouth et al.
9,763,488 B2 * 9/2017 Bologna ..... A42B 3/122
9,924,756 B2 3/2018 Hyman
10,159,296 B2 12/2018 Pietrzak et al.
10,235,801 B2 * 3/2019 Ebisawa ..... A42B 3/125
10,258,098 B2 4/2019 Erb et al.
11,026,466 B2 * 6/2021 Vanhoutin ..... A42B 3/20
2002/0152542 A1 * 10/2002 Dennis ..... A42B 3/121 2/414
2004/0204904 A1 * 10/2004 Ebisawa ..... A42C 3/06 702/170
2005/0183188 A1 * 8/2005 Rudolf ..... A42B 3/127 2/414
2006/0260026 A1 * 11/2006 Doria ..... A42B 3/127 2/414
2009/0031481 A1 * 2/2009 Dennis ..... A42B 3/121 2/414
2010/0186150 A1 7/2010 Ferrara et al.
2012/0036620 A1 * 2/2012 Harris ..... A42B 3/127 2/414
2012/0192337 A1 * 8/2012 Divine ..... A42B 3/127 2/414
2013/0000017 A1 * 1/2013 Szalkowski ..... F41H 1/08 2/414
2013/0007950 A1 * 1/2013 Arai ..... A42B 3/127 2/414
2013/0291289 A1 * 11/2013 Szalkowski ..... A42B 3/12 2/414
2013/0340147 A1 * 12/2013 Giles ..... A42B 3/22 2/412
2014/0020158 A1 1/2014 Parsons et al.
2014/0081601 A1 3/2014 Zhang et al.
2014/0223641 A1 * 8/2014 Henderson ..... A42B 3/065 2/411
2014/0237706 A1 * 8/2014 O'Conner ..... A42B 1/08 2/410
2015/0047110 A1 2/2015 Chilson
2015/0272255 A1 10/2015 Galaitsis et al.
2015/0305430 A1 * 10/2015 Rush ..... A42B 3/124 2/412
2016/0015111 A1 * 1/2016 Latruffe ..... A42B 3/124 2/412
2016/0021966 A1 * 1/2016 Warmouth ..... A42B 3/122 2/413
2016/0029733 A1 * 2/2016 Kovarik ..... A42B 3/20 2/424
2017/0196290 A1 * 7/2017 Scanlon ..... A42B 3/062
2017/0295882 A1 10/2017 Walsh et al.
2018/0021661 A1 * 1/2018 Bologna ..... A42B 3/20 2/414
2018/0235303 A1 8/2018 Vito
2018/0235304 A1 * 8/2018 Fischer ..... A42B 3/124
2018/0343953 A1 12/2018 Erb et al.
2019/0059498 A1 2/2019 Kovarik et al.
2019/0216159 A1 7/2019 Vanhoutin et al.
2020/0178637 A1 * 6/2020 Tenenbaum ..... F16F 7/12

OTHER PUBLICATIONS

Ferhalucard Meneses, "ferh schutt f7", web. YouTube, Jan. 12, 2018, https://www.youtube.com/watch?v=SwYjV566rro (Year: 2018).*

* cited by examiner

HELMET WITH CUSTOM-FIT LINER

CROSS-REFERENCE TO RELATED APPLICATIONS

This application is a continuation of U.S. patent application Ser. No. 18/648,229, filed on Apr. 26, 2024; which is a continuation of U.S. patent application Ser. No. 17/340,907, filed on Jun. 7, 2021; which is a continuation of U.S. patent application Ser. No. 16/815,861, filed on Mar. 11, 2020, and issued on Jun. 8, 2021 as U.S. Pat. No. 11,026,466; which claims priority from U.S. provisional patent application No. 62/836,923, filed Apr. 22, 2019. The entirety of the related applications listed above are incorporated herein by reference for all purposes.

STATEMENT REGARDING PRIOR DISCLOSURES BY THE INVENTORS OR JOINT INVENTORS UNDER 37 C.F.R. 1.77(b)(6)

Less than one year before the filing date of U.S. Provisional Patent Application Ser. No. 62/836,923, commercial availability of a football helmet under the name Schutt F7 UR1 was announced by the applicant/assignee Schutt Sports. The applicant/assignee obtained the Schutt F7 UR1 football helmet directly or indirectly from the inventors of the present application. The Schutt F7 UR1 football helmet is an "inventor-originated disclosure" within the exceptions defined in 35 U.S.C. 102(b)(1).

BACKGROUND OF THE SUBJECT TECHNOLOGY

The subject technology concerns football helmets, which are worn to protect the head of a football player from impacts sustained during play.

Modern football helmets generally comprise a plastic shell; internal padding inside the shell, attached directly or indirectly to the inner surface of the shell by, for example, T-nuts or hook-and-loop tape; and a face guard (i.e., a facemask) attached to the shell.

Wearers of football helmets have differently shaped and sized heads, and different preferences for how their helmets should fit, therefore it is necessary to provide technology for fitting helmets to many different wearers. Football helmet shells are rigid articles of manufacture made by a molding process, and a manufacturer of football helmets may have a limited number of molds of different sizes of a given style of helmet. It is common for a manufacturer to offer a style of football helmet in a limited range of helmet shell sizes, from "small" to "extra-large," for example, each size requiring a different mold.

The needs of helmet wearers require more customization than can be afforded by a limited range of shell sizes. This is addressed by the structure of the internal padding. There is a need for internal padding configurations adapted to fit helmet wearers having many different requirements.

Additionally, to be usable for competitive sports play, a helmet must meet certain standards. In the United States, the National Operating Committee on Standards for Athletic Equipment ("NOCSAE") develops performance standards for protective equipment used in a variety of sports, including football helmets and faceguards. Generally, new football helmets and face guards must meet NOCSAE standards, and must be certified as such, to be marketable and usable in competitive football play in at least the collegiate varsity and professional levels. As used herein, "NOCSAE Standards" shall mean the effective NOCSAE standards applicable to football helmets and faceguards as amended.

Although NOCSAE sets performance and test standards for athletic equipment, NOCSAE itself does not certify or approve athletic equipment. At the present time, NOCSAE requires third-party certification of compliance with its standards by a neutral, independent body. Currently, Safety Equipment Institute (SEI) oversees the certification of athletic equipment to NOCSAE standards. Equipment including football helmets that is certified to meet NOCSAE standards may be labeled or stamped with the appropriate certification mark, such as "Meets NOCSAE Standards" or "SEI Certified" or the like. As used herein, "NOCSAE-certified" shall mean equipment that is certified to meet NOCSAE's requirements for football helmets or faceguards as applicable, and which may or may not bear a NOCSAE certification mark. NOCSAE-certified equipment is deemed to meet NOCSAE Standards, as those terms are used herein.

SUMMARY OF THE SUBJECT TECHNOLOGY

According to a non-limiting embodiment of the subject technology, a helmet is provided with a composite helmet liner to improve and customize the fit of the helmet to the wearer. The composite liner consists of a base liner and a selected group of fit elements, for example, fit pods, removably attached to the inner surface of the base liner (i.e., the surface of the base liner facing the wearer's head). The fit pods are selected from a set of fit pods having different properties, for example, different sizes, thicknesses, densities, and cross-sections.

The selection of fit pods from the set may be aided by taking anatomical measurements of the wearer's head and analyzing the measurements with respect to the geometry of the helmet to produce a pressure map. The measurements may be taken by physical contact or by non-contact means. The fit pods may be selected to optimize a pressure map, and thus optimize the fit, for a given wearer of the helmet.

The subject technology is applicable to helmets for use in a variety of sports including football, hockey, baseball and lacrosse, as well as other types of protective helmets. Although this disclosure will focus on the practical application of the subject technology to football helmets, it is applicable to other types of protective helmets.

According to another aspect of the subject technology, an inflatable base liner is provided in the shell. The liner is adapted to be disposed within the shell of a helmet, the liner comprising at least one inflatable cell, the at least one inflatable cell connected by a tube for fluid communication with a remote valve unit for inflating the inflatable cell, the remote valve unit including a needle valve having an valve hole for admission of a needle of a needle pump, the remote valve unit adapted to reside within an opening of a helmet shell such that the valve hole is accessible from outside the shell, the shell having an outer surface and an inner surface, the remote valve unit having an outer flange adapted to be disposed on the outer surface and an inner flange adapted to be disposed on the inner surface.

DETAILED DESCRIPTION OF THE SUBJECT TECHNOLOGY

Figure 1:
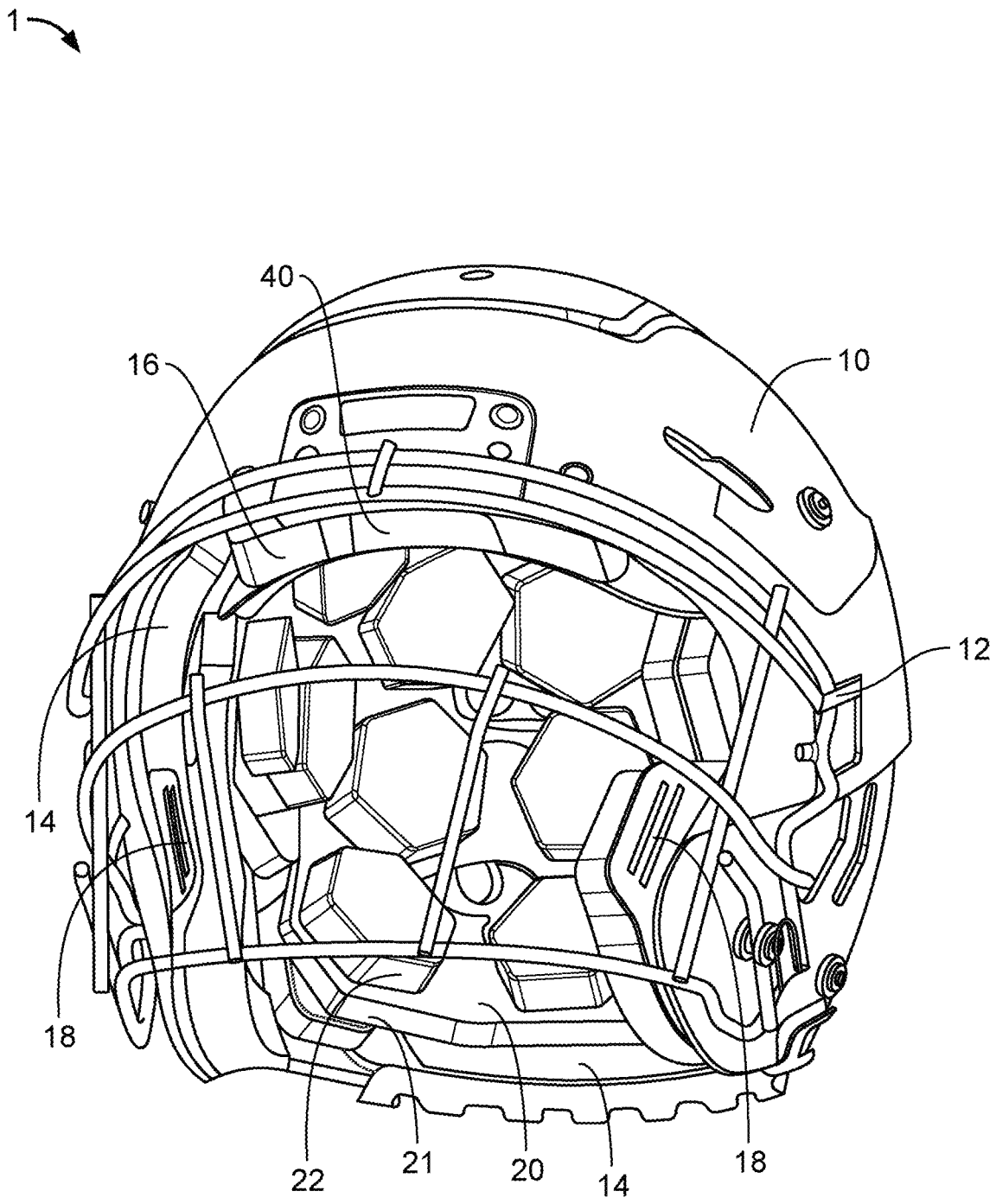
FIG. 1 is an elevation view of a football helmet according to a non-limiting embodiment of the subject technology.

According to the subject technology, a helmet comprises a plastic shell provided with inner padding structures to absorb shock and customize the fit of the helmet to the wearer. Modern football helmet shells are normally made of ABS or polycarbonate plastic. It will be understood that various types of plastic and other rigid materials including composites incorporating Innegra, Kevlar, fiberglass, and carbon fiber materials, may be used to make a football shell and are within the scope of the subject technology. A football helmet shell has a front region, a crown region, a rear region, a left side region, a right side region, an inner surface and an outer surface. Earflaps of the shell cover the left and right sides of the head and contain ear holes. Additional holes are formed in the shell for ventilation or for attachment of internal padding, chinstraps, face guards, and visors.

Many varieties and structures of internal padding are known in the art. Internal padding may include helmet liners, for example, foam elements encapsulated within cells formed between polymer (e.g., vinyl or TPU) layers, and some or all of the cells may be inflatable and deflatable through a valve in the case of an "air liner." Internal padding may also include a comfort layer or layers inside the liners (i.e., between the liners and the wearer's head), comprised of a soft material such as fleece or soft polymer foam to improve fit and comfort. The internal padding also helps to absorb the shock of blows sustained to the helmet during sports play. Internal padding structures and related systems which may be used with the subject technology are disclosed, for example, in U.S. Pat. Nos. 8,069,498, 9,131,744, 9,622,533, and 10,258,098, and co-pending U.S. patent application Ser. No. 15/855,876 (published as U.S. Published Patent Application No. 2018-0343953) and Ser. No. 16/269,664 (published as U.S. Published Patent Application No. 2019-0216159), all of which are owned by the assignee of the present application and are incorporated herein by reference for their technical teachings.

Internal padding of a football helmet may include robust shock-absorbing pads or padding made of formed, thermoformed or molded sheets of thermoplastic urethane (TPU) polymer material. Football helmets with internal padding comprising (among other elements) shock-absorbing pads or padding made of TPU are described, for example, in U.S. Pat. Nos. 8,069,498, 9,131,744, and 9,622,533, and co-pending U.S. Published Patent Applications No. 2018-0343953 and 2019-0216159.

According to the subject technology, the internal padding of a football helmet comprises shock-absorbing elements attached to an inner surface of the plastic shell, for example, TPU shock absorbing pads as disclosed in the incorporated patents and applications referenced above. Inward of the TPU shock absorbing pads are disposed customizable liners consisting of a base liner and plurality of additional pads removably attached to the base liner by, for example, hook-and-loop fasteners. In a non-limiting embodiment of the subject technology, the removable pads are "fit pods," each fit pod consisting of a liner cell or cells containing a pad or pads of foam material. A variety of fit pods may be provided in different sizes and shapes, and with different foam materials, to achieve a wide variety of possible liner configurations.

Figure 2:
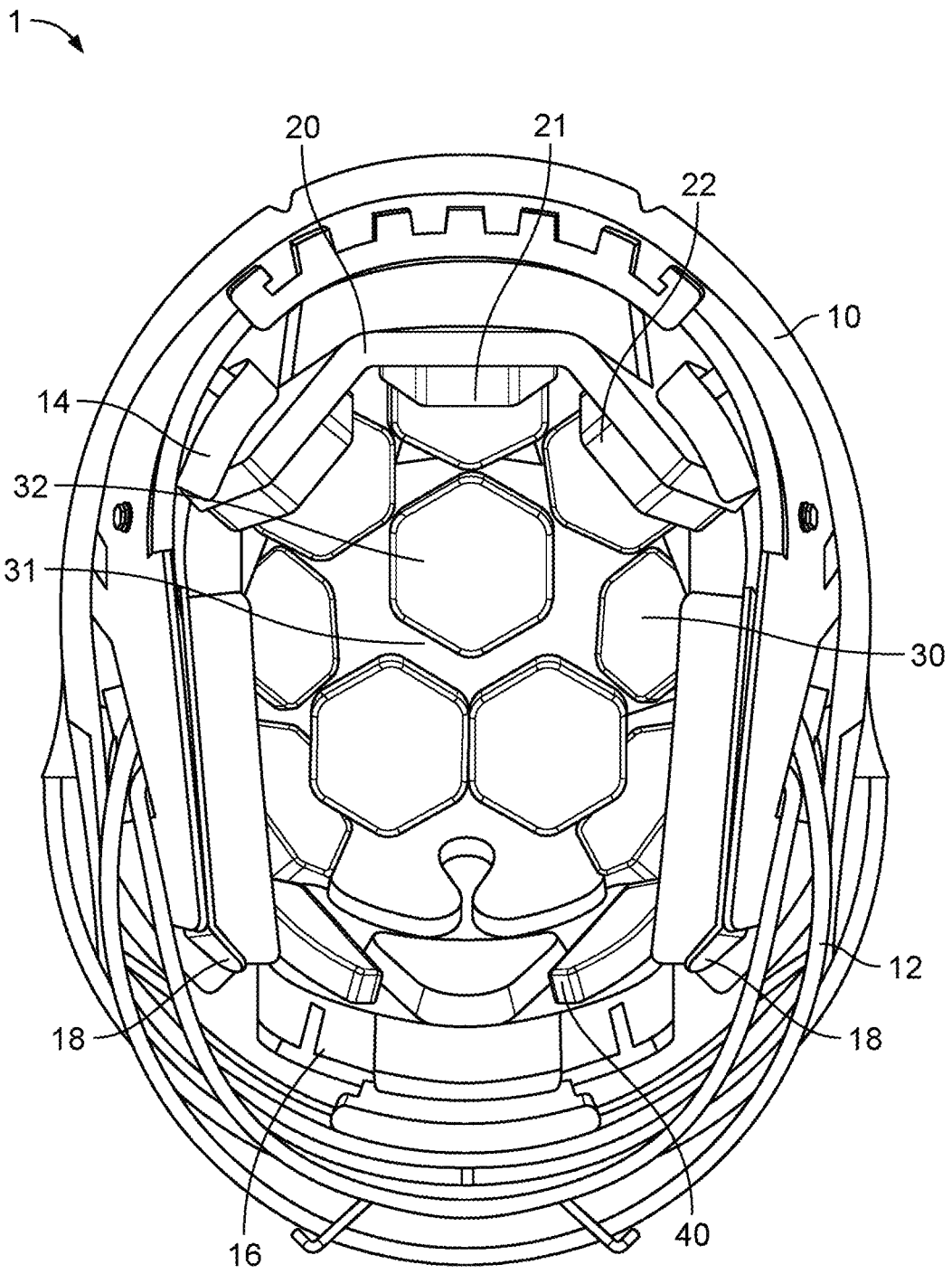
FIG. 2 is a bottom view into the interior of a football helmet according to a non-limiting embodiment of the subject technology.
Figure 3:
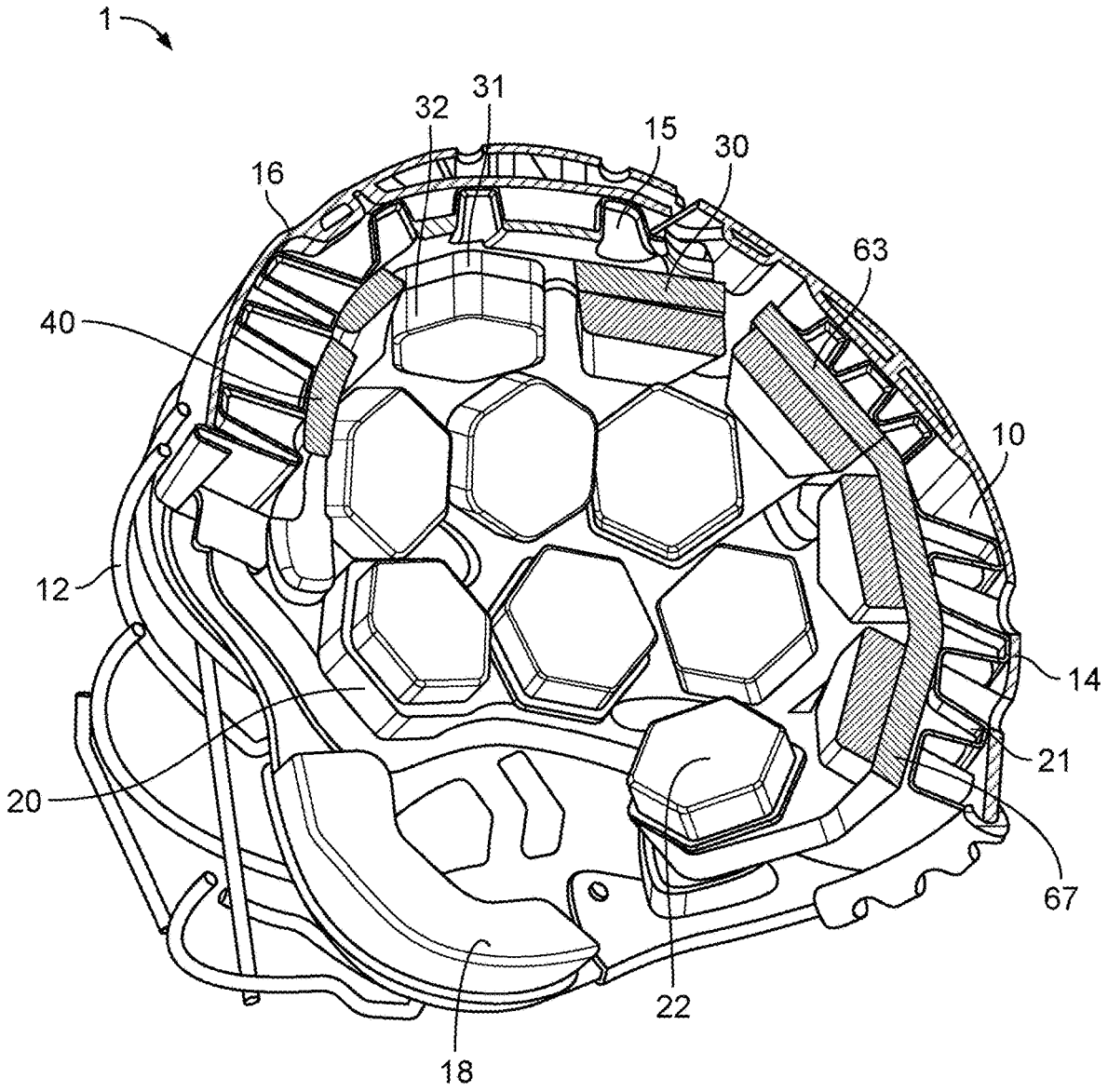
FIG. 3 is a cross-sectional view into the interior of a football helmet according to a non-limiting embodiment of the subject technology.
Figure 4:
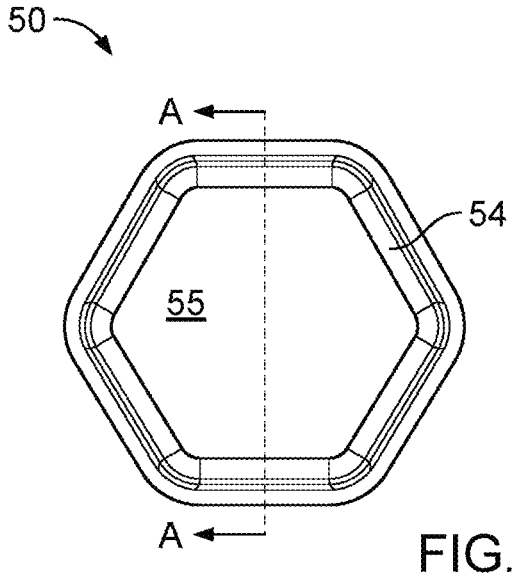
FIG. 4 is a plan view of a fit pod according to a non-limiting embodiment of the subject technology.
Figure 5:
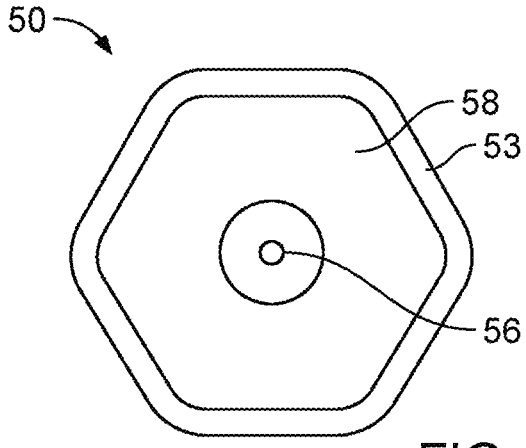
FIG. 5 is a bottom view of a fit pod according to a non-limiting embodiment of the subject technology.
Figure 6:
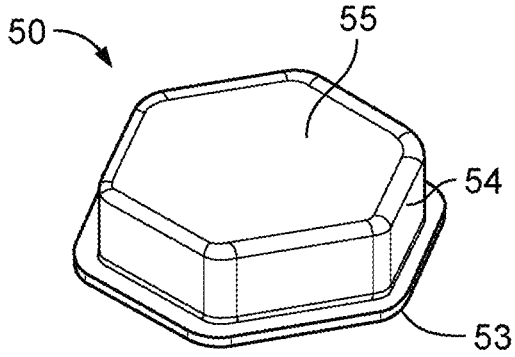
FIG. 6 is an isometric view of a fit pod according to a non-limiting embodiment of the subject technology.
Figure 7:
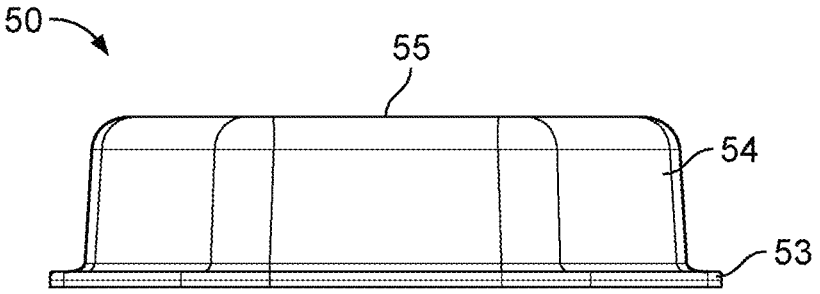
FIG. 7 is an elevation view of a fit pod according to a non-limiting embodiment of the subject technology.
Figure 8:
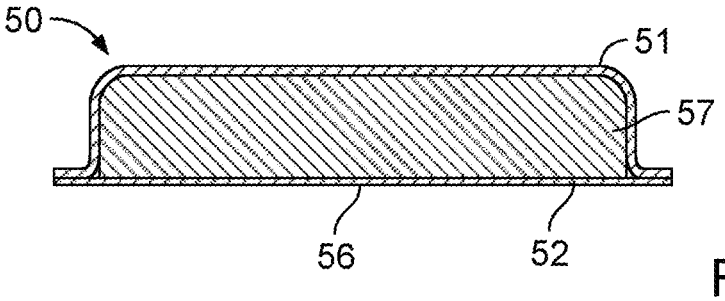
FIG. 8 is a cross-sectional view of a short fit pod according to a non-limiting embodiment of the subject technology.
Figure 9:
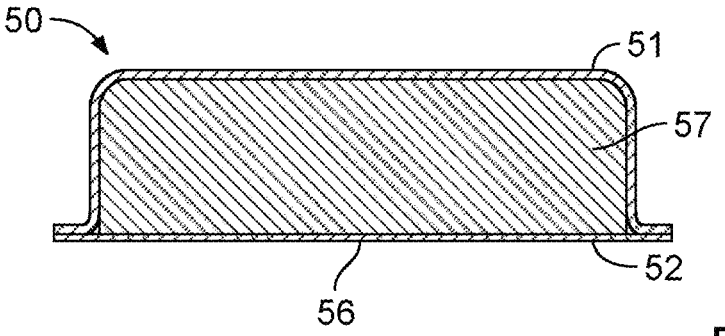
FIG. 9 is a cross-sectional view of a medium fit pod according to a non-limiting embodiment of the subject technology.
Figure 10:
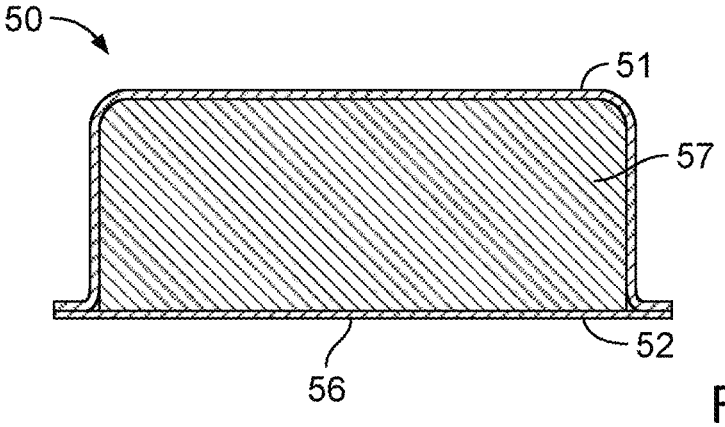
FIG. 10 is a cross-sectional view of a tall fit pod according to a non-limiting embodiment of the subject technology.
Figure 11:
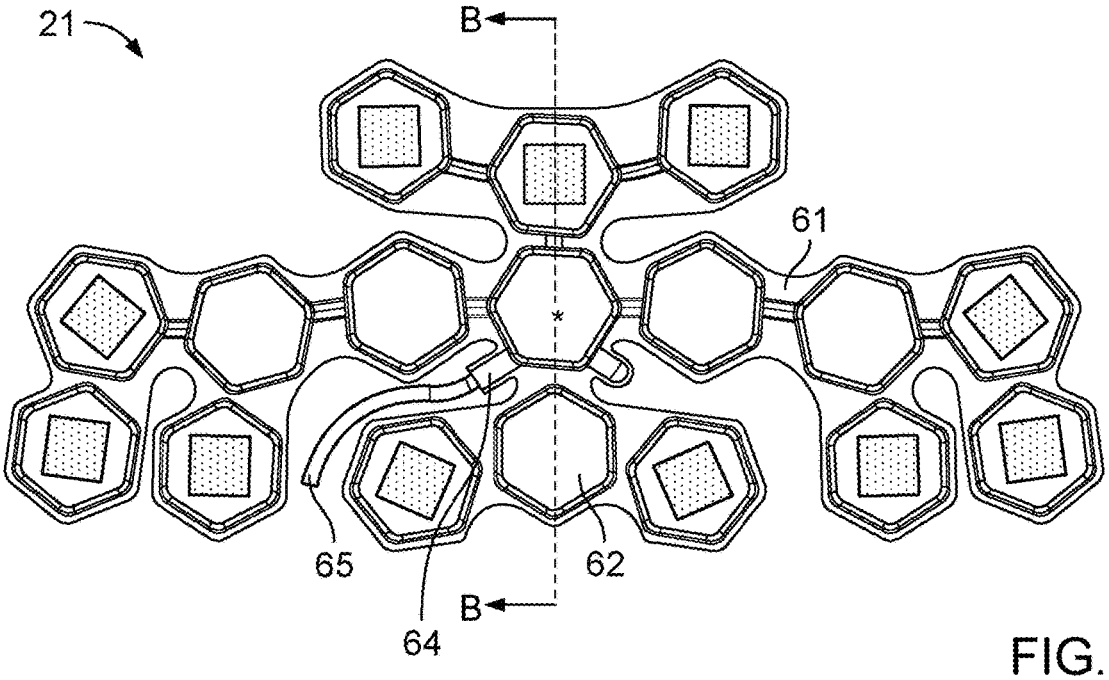
FIG. 11 is a plan view of a lateral base liner according to a non-limiting embodiment of the subject technology.
Figure 12:
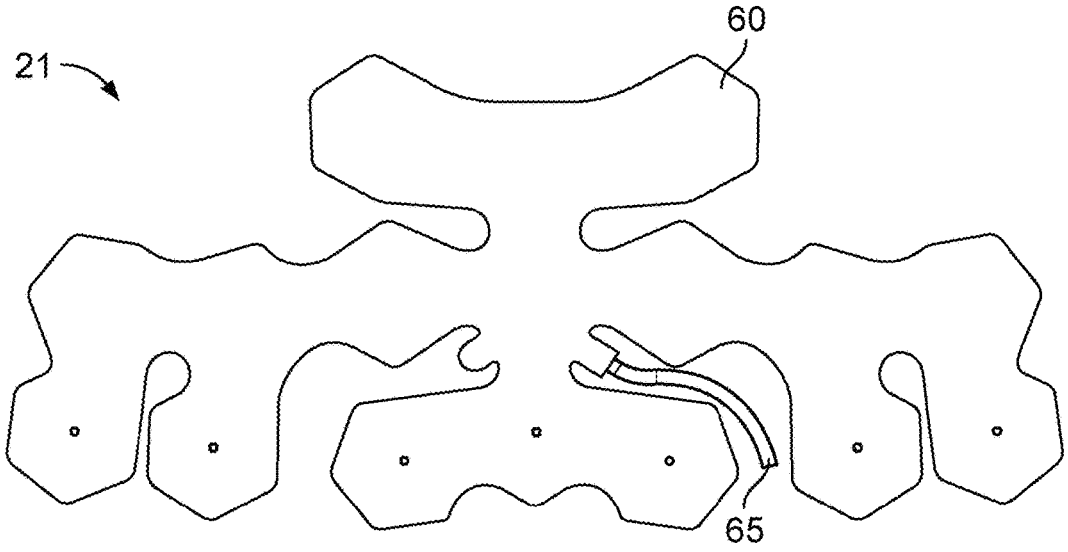
FIG. 12 is a bottom view of a lateral base liner according to a non-limiting embodiment of the subject technology.
Figure 13:
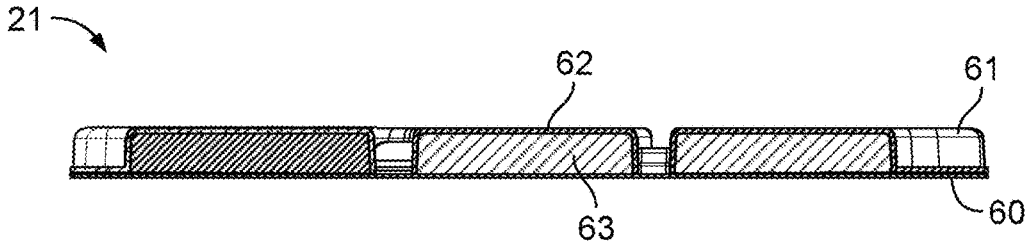
FIG. 13 is a cross-sectional view along the line B-B of a lateral base liner according to a non-limiting embodiment of the subject technology.
Figure 14:
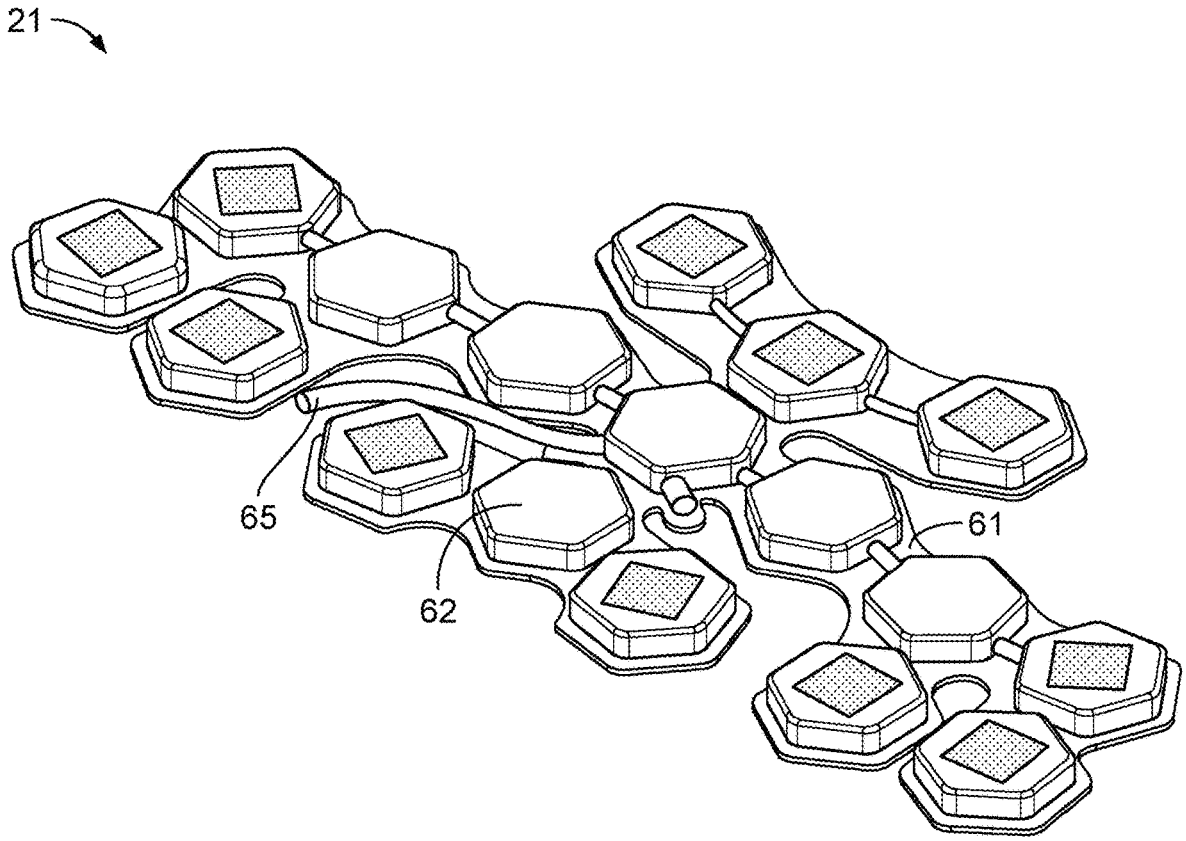
FIG. 14 is an isometric view of a lateral base liner according to a non-limiting embodiment of the subject technology.
Figure 15:
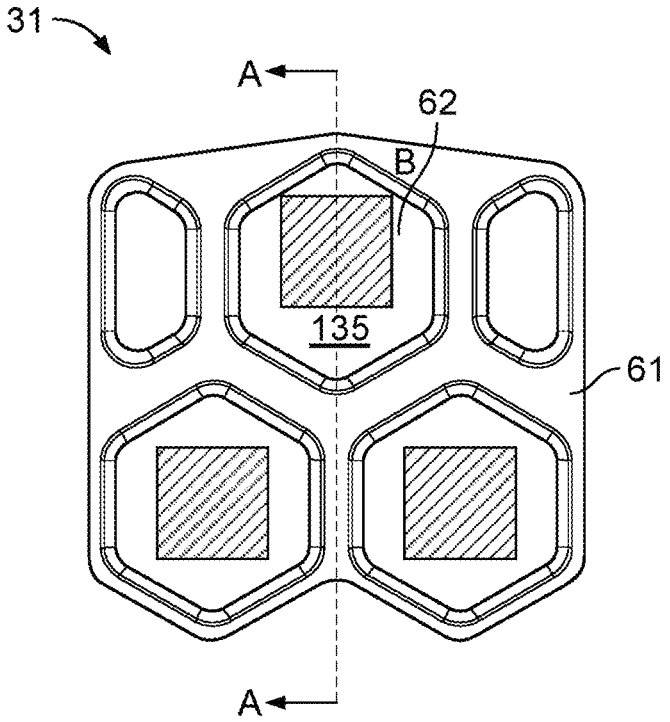
FIG. 15 is a plan view of a crown base liner according to a non-limiting embodiment of the subject technology.
Figure 16:
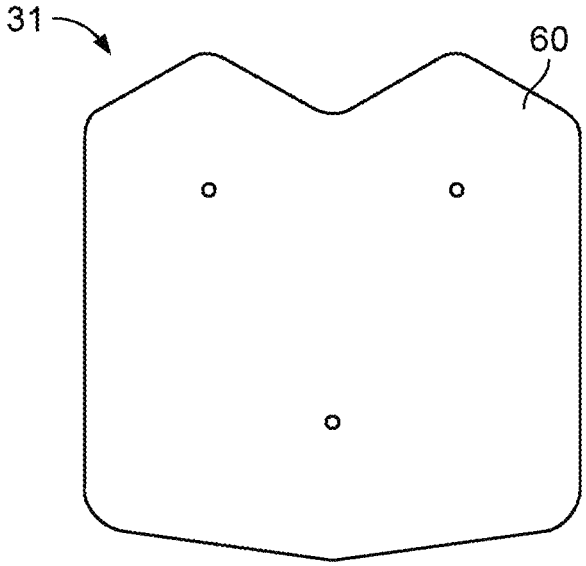
FIG. 16 is a bottom view of a crown base liner according to a non-limiting embodiment of the subject technology.
Figure 17:
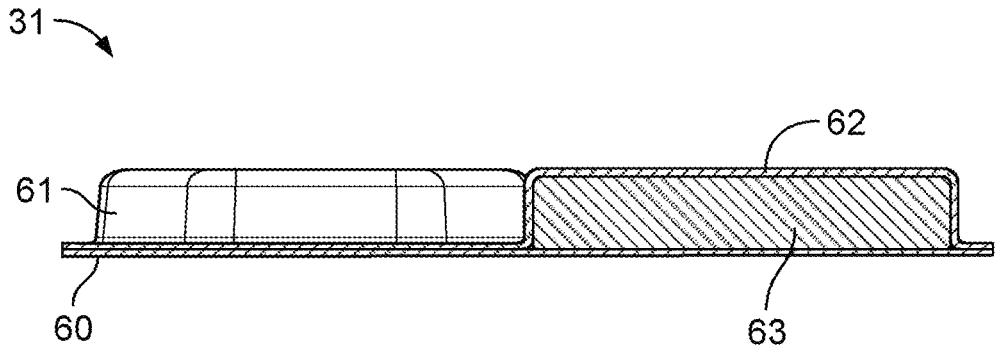
FIG. 17 is a cross-sectional view along the line A-A of a crown base liner according to a non-limiting embodiment of the subject technology.
Figure 18:
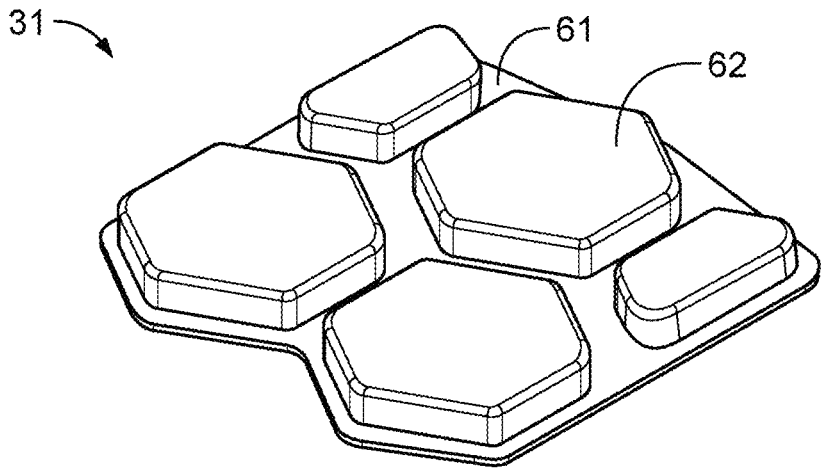
FIG. 18 is an isometric view of a crown base liner according to a non-limiting embodiment of the subject technology.
Figure 19:
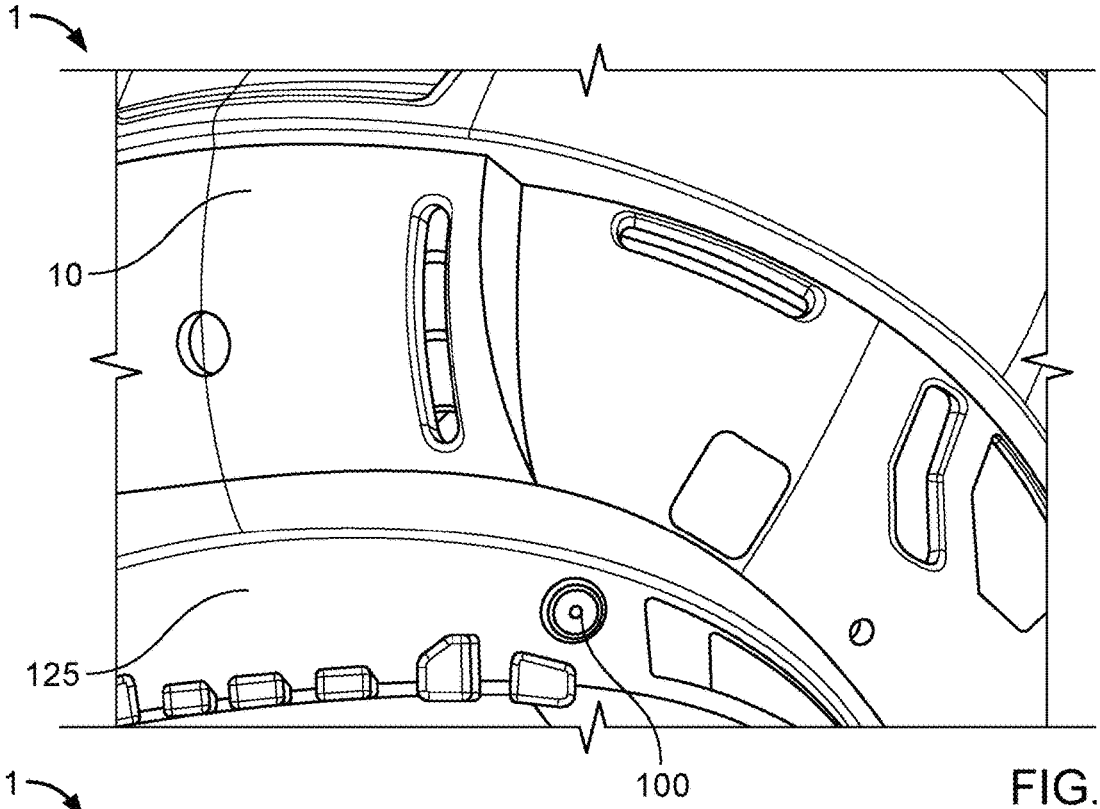
FIG. 19 is a rear detail view of a football helmet according to a non-limiting embodiment of the subject technology showing a remote valve unit installed in the shell.
Figure 20:
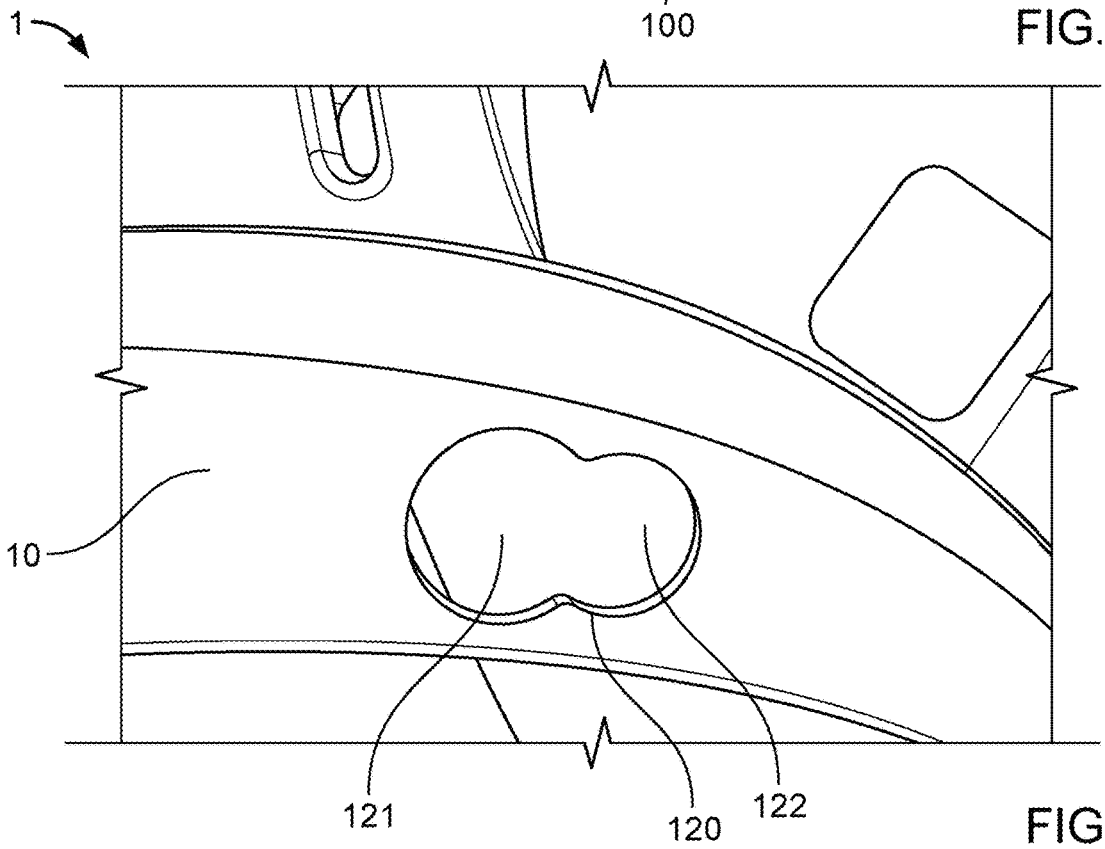
FIG. 20 is a rear detail view of a football helmet shell according to a non-limiting embodiment of the subject technology showing a valve mounting hole in the shell.
Figure 21:
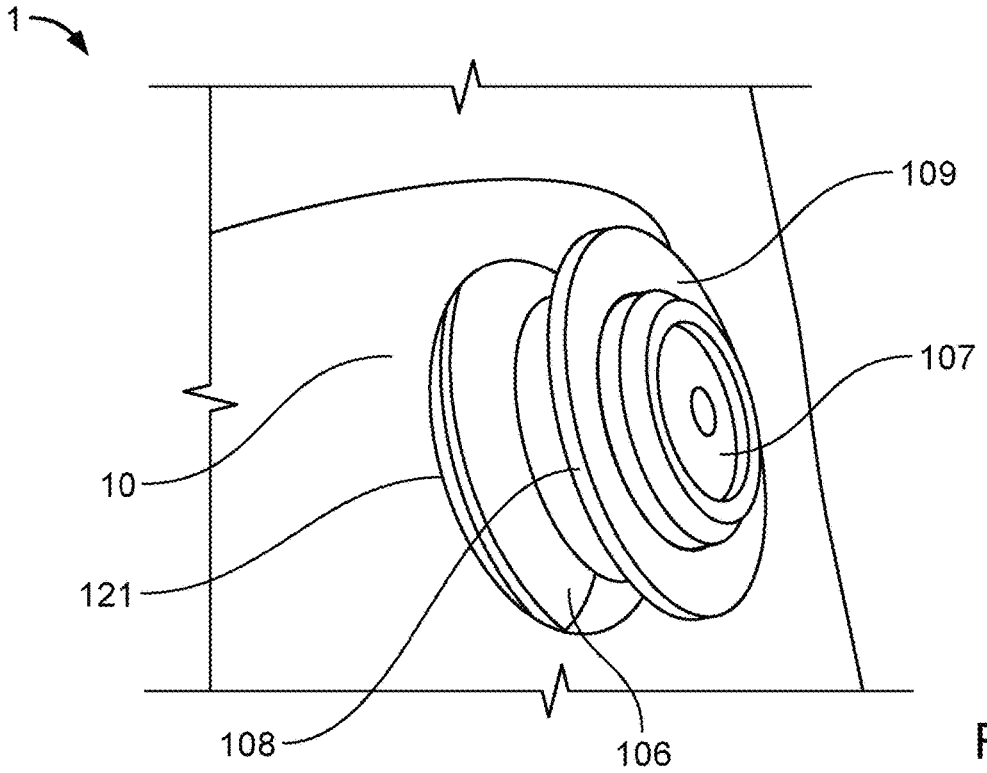
FIG. 21 is a rear detail view of a football helmet shell according to a non-limiting embodiment of the subject technology showing a remote valve unit being installed.
Figure 22:
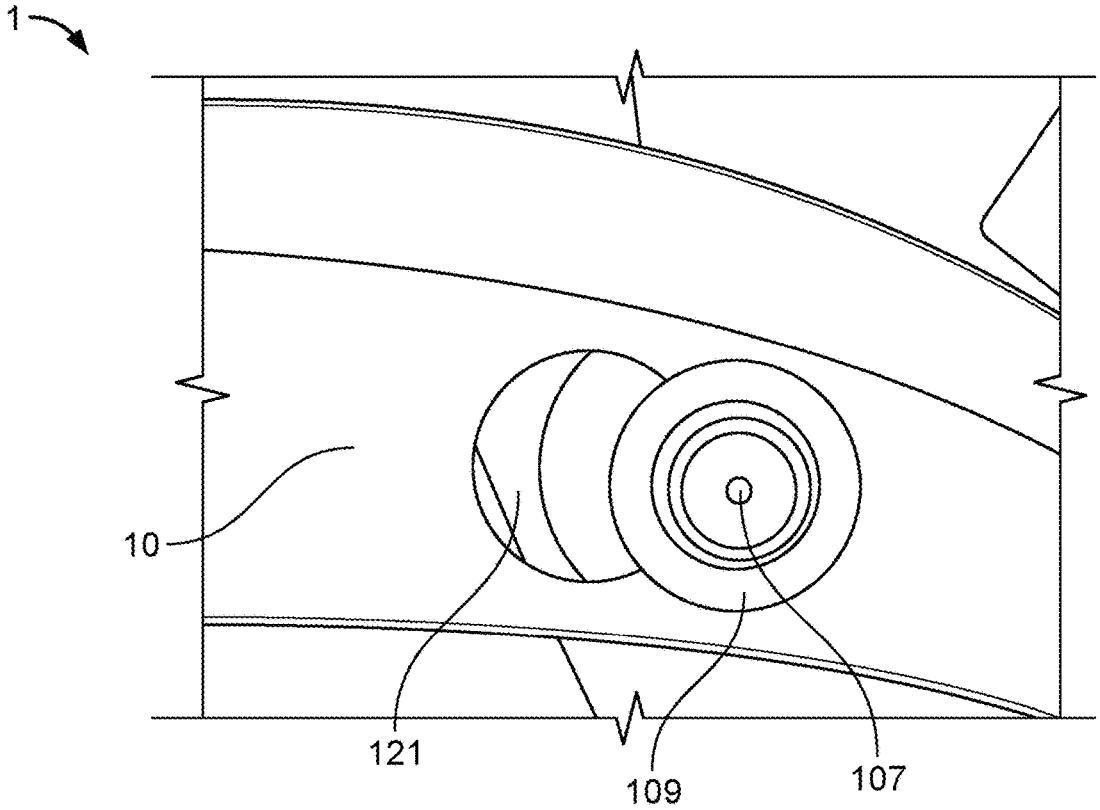
FIG. 22 is a rear detail view of a football helmet according to a non-limiting embodiment of the subject technology showing a remote valve unit installed in the shell.
Figure 23:
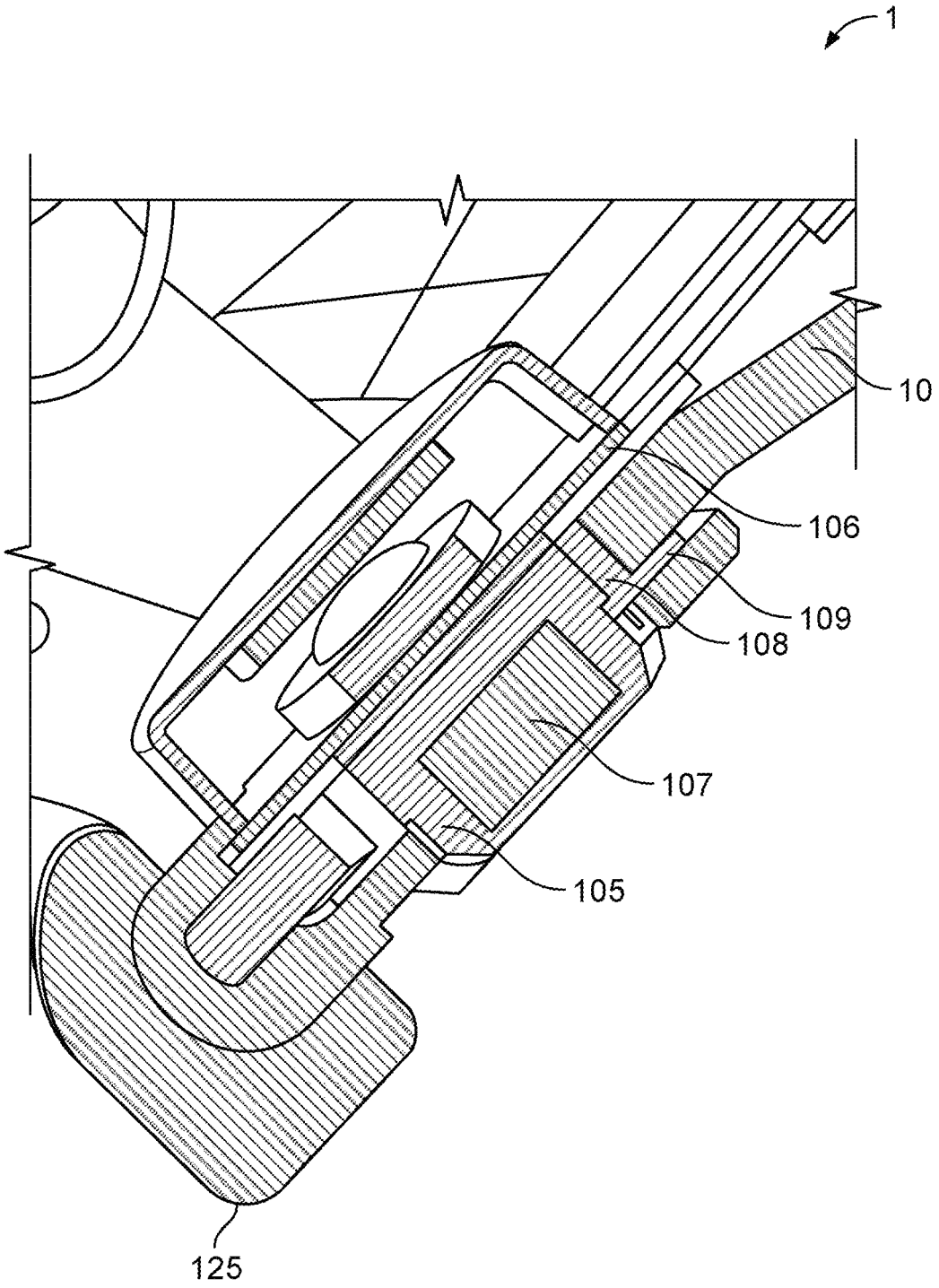
FIG. 23 is a cross-sectional detail view of a football helmet according to a non-limiting embodiment of the subject technology showing a remote valve unit installed in the shell.
Figure 24:
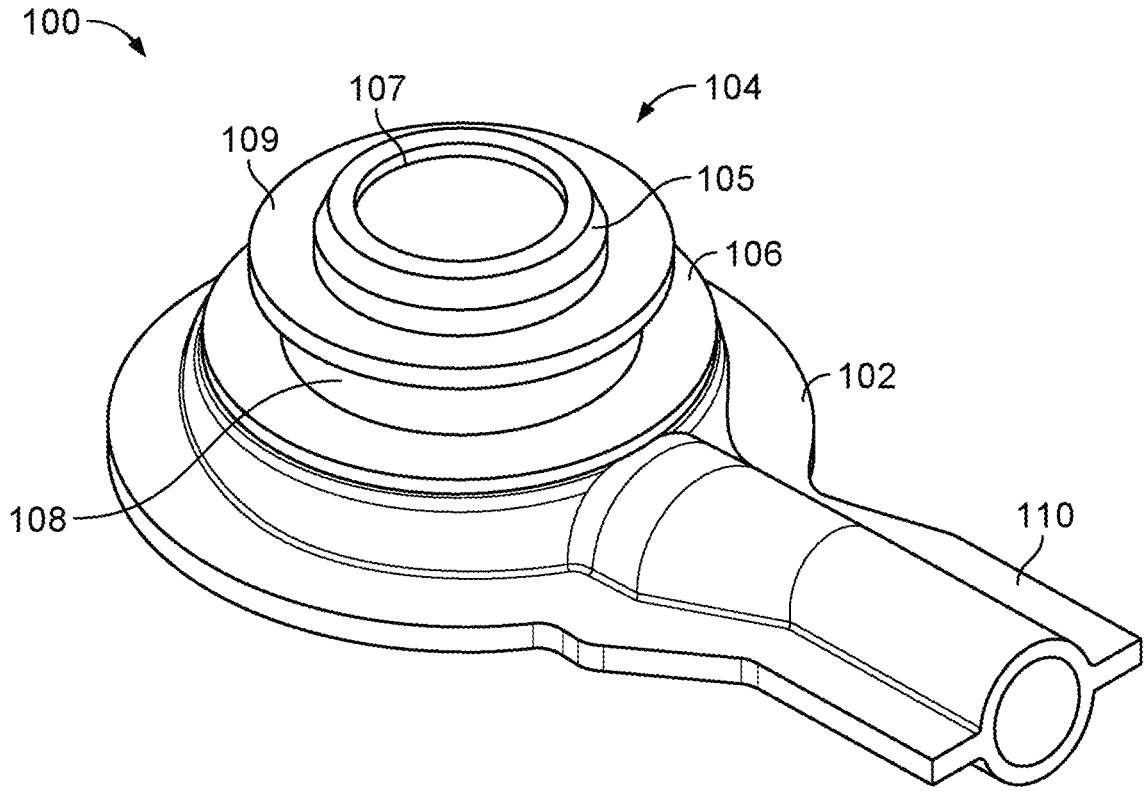
FIG. 24 is an isometric view of a remote valve unit according to a non-limiting embodiment of the subject technology.
Figure 25:
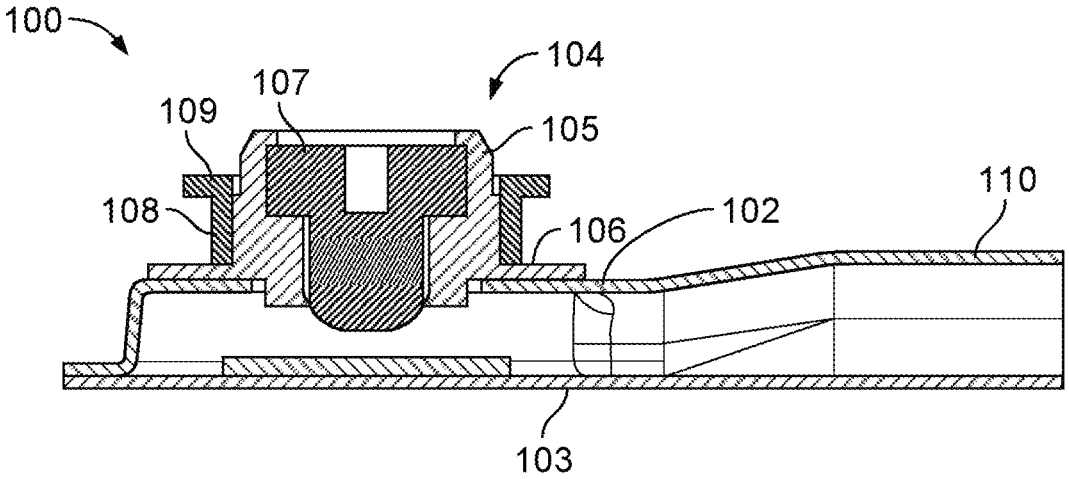
FIG. 25 is a cross-sectional view along the line A-A of a remote valve unit according to a non-limiting embodiment of the subject technology.
Figure 26:
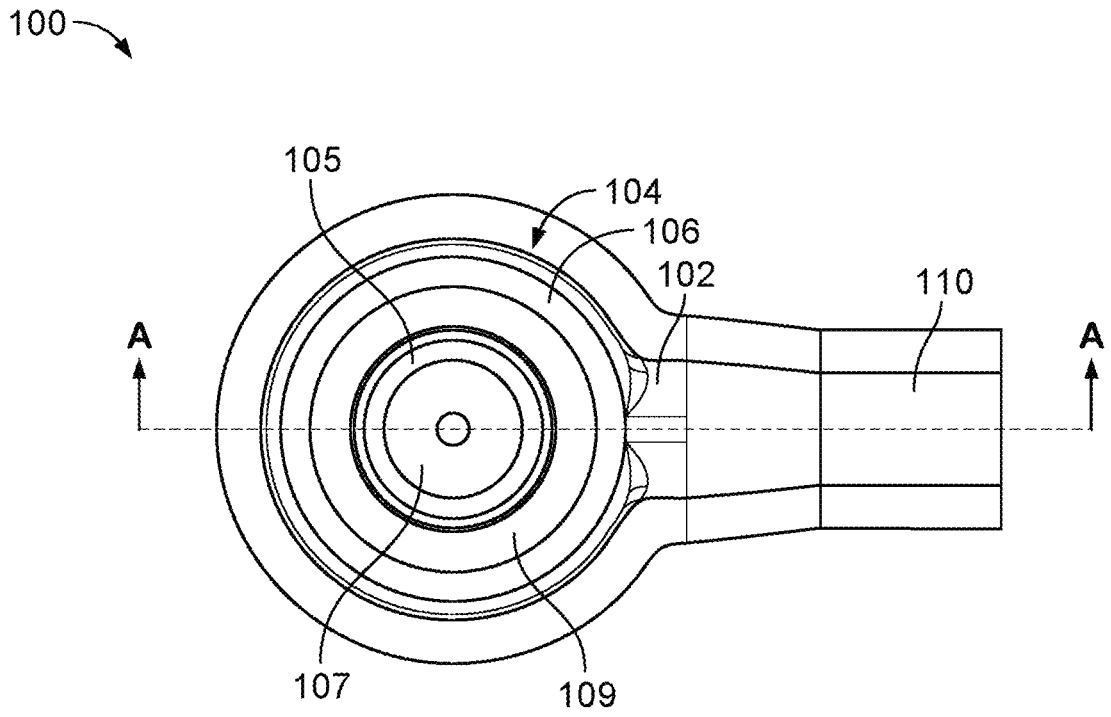
FIG. 26 is a plan view of a remote valve unit according to a non-limiting embodiment of the subject technology.
Figure 27:
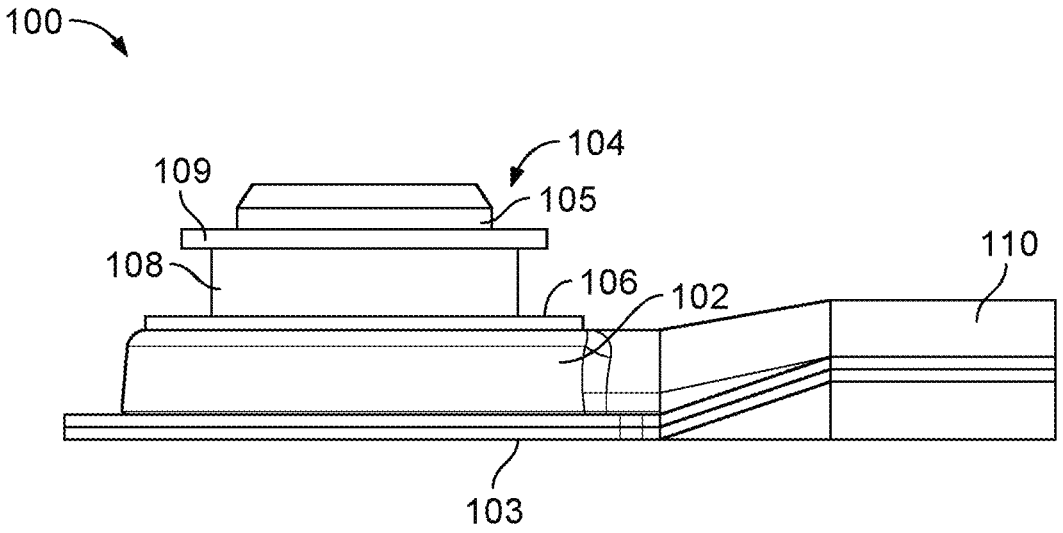
FIG. 27 is an elevation view of a remote valve unit according to a non-limiting embodiment of the subject technology.

According to the non-limiting embodiment of FIGS. 1-3, football helmet 1 comprises shell 10, faceguard 12 removably attached to shell 10, and cheek supports 18 removably attached to shell 10. In the non-limiting embodiment shown, shell 10 is the shell of co-pending U.S. patent application Ser. No. 15/855,876 or 16/269,664; and cheek supports 18 (if present) may be as disclosed in co-pending U.S. patent application Ser. No. 15/855,876 or U.S. Pat. No. 10,258,098.

Disposed within shell 10 and connected to its inner surface are lateral TPU shock absorber assembly 14, crown TPU shock absorber 15, and front TPU shock absorber 16. In the non-limiting embodiment shown, shock absorbers 14, 15 are substantially as shown for example in co-pending U.S. patent application Ser. No. 15/855,876. Front TPU shock absorber 16 is preferably a dual-stiffness TPU front pad as disclosed in co-pending U.S. patent application Ser. No. 16/269,664.

Customizable and configurable helmet liners are disposed within helmet within the TPU shock absorbers 14, 15, and 16. According to a non-limiting embodiment of the subject technology, helmet 1 has helmet liners consisting of lateral liner 20, crown liner 30, and front liner 40. Lateral liner 20 is disposed in the rear area and side areas of helmet 1 and includes base lateral liner 21 and fit pods 22 (only one is numbered in FIGS. 1-3) removably attached to base lateral liner 21. Crown liner 30 is disposed in the crown area of helmet 1 and consists of base crown liner 31 and fit pods 32 (only one is numbered in FIGS. 1-3) removably attached to base crown liner 31. The provision of fit pods 22, 32 in lateral liner 20 and crown liner 30 allows those liners to be configured in a wide variety of ways to custom-fit helmet 1 to a wearer. In this embodiment, the front liner is not customizable with fit pods, and is the front liner of co-pending U.S. patent application Ser. No. 16/269,664. However, a front liner consisting of a base front liner and attached fit elements is within the scope of the subject technology.

Turning first to the structure of the fit pods, FIGS. 4-10 show views of a fit pod according to a non-limiting embodiment of the subject technology. In the embodiment shown, fit pod 50 is a single liner cell formed by top sheet 51 of polymer material such as TPU or vinyl having a pocket formed therein, which is sealed to bottom sheet 52 also of polymer material, to form an enclosed liner cell. A small vent hole may be provided in the top or bottom sheet to equalize air pressure with the environment. Fit pod 50 has base 53 formed by bottom sheet 52. Fit pod 50 has walls 54 rising from base 53 to peak 55, which are formed by top sheet 51. Bottom sheet 52 preferably has a small hole 56 therein to vent fit pod 50 to the atmosphere. Walls 54 may taper inward from base 53 to peak 55 or may rise squarely from base 53 to peak 55.

Fit pod 50 contains pad 57 of energy-absorbing polymer foam material, shaped and sized to fit within and fill or substantially fill the cell of fit pod 50. The foam material of pad 57 may be slow-response foam, memory foam, Poron, Confor, Omalon, D3o, or other energy absorbing-foam. Pad 57 may consist of a single pad of a single polymer foam material. Alternatively, pad 57 may consist of a composite pad of two or more layers of the same foam material, or different foam materials. Alternatively, pad 57 may consist of any type of foam material usable in a sports helmet.

Bottom sheet 52 of fit pod 50 is provided with means to removably attach base 53 to a substrate. Preferably, a pad 57 of hook or loop material is bonded to bottom sheet 52, which will removably mate with a sheet of hook or loop material bonded to a base liner, which may be crown base liner 31 or lateral base liner 21 for example.

According to the subject technology, a set of fit pods having different properties is provided, from which a selection of fit pods is made to enable customization of helmet 1 to a wearer. The fit pods may differ in their height, width, shape, size, cross-section, selection of type of foam material, thickness, stiffness, firmness, density and/or hardness, for example. In a non-limiting embodiment, the fit pods in the provided set of pods have the same hexagonal cross section and same type of foam material, but differ in the stiffness and thickness of foam material (and therefore, will have different heights).

In a non-limiting embodiment of the subject technology, the set of fit pods is a multiset of six different types of pod, all having pads of substantially the same cross-section, but different heights (i.e. thicknesses of foam pad) and different foam pad materials. (It should be understood that a "multiset" is a set which permits elements to be repeated within the set. Any reference to a "set" herein is a multiset unless stated otherwise.) In a non-limiting embodiment, the multiset consists of 10 to 20 instances of each type of pod. In a non-limiting embodiment, the types of pods are characterized as follows (all thicknesses in an uncompressed state):

TABLE 1

| Pod | Thickness (in) | Foam Material | Indentation Force Deflection (lbf) (per data sheet) | 50% Compression Load Deflection (psi) (per data sheet) |
|---|---|---|---|---|
| AS | 3/8 | Confor CF-45 | 48 | 0.86 |
| AF | 3/8 | Confor CF-47 | 63 | 1.1 |
| BS | 9/16 | Confor CF-45 | 48 | 0.86 |
| BF | 9/16 | Confor CF-47 | 63 | 1.1 |
| CS | 3/4 | Confor CF-45 | 48 | 0.86 |
| CF | 3/4 | Confor CF-47 | 63 | 1.1 |

It will be appreciated that the fit pods in this non-limiting embodiment are interchangeable. That is, the bases of all the fit pods have the same geometry, and any fit pod can be used in place of any other fit pod. Additionally, it will be appreciated that the fit pods are pre-fabricated, without the necessity of custom-manufacturing each fit pod to fit a particular user.

According to a further aspect of the subject technology, base liners are provided within the helmet, between the fit pods and the TPU shock absorbers. In a non-limiting embodiment of the subject technology, two base liners are provided, consisting of a base lateral liner 21 disposed in the rear and side areas of the helmet, and a base crown liner 31 disposed in the crown area of the helmet.

In general construction, base liners according to the subject technology are formed of bottom sheet 60 and a top sheet 61 of a flexible, non-porous polymer material which may be TPU or PVC material, for example. Pockets are formed in the top sheet 61. The bottom sheet 60 is bonded to the top sheet 61 to seal the recesses or pockets and thereby form cells 62 (only one is numbered in the Figures). In a non-limiting embodiment, the cells include pads 63 (only one is numbered in the Figures) of foam polymer material of the types used in sports helmets, preferably a shock-absorbing foam such as Poron, Confor, Omalon, D3o, or other energy absorbing-foam material. The included pads 63, and the overall base liner 21, 31, may be relatively thin compared to the liners of the incorporated patents and patent applications, because the base liners 21, 31 do not fill the entire space between the TPU shock absorbers 14, 15 and the wearer's head, due to the presence of the fit pods 22, 32. In a non-limiting embodiment, the thickness of the included pads 63 is ⅜ inch, or approximately ⅜ inch. Preferably, the base liner or base liners of the helmet are not configured to contact the wearer's head at any point. Additionally, top sheet 61 has attached hook/loop pads to attach to hook/loop pads on the TPU shock absorbers.

Figure 30:
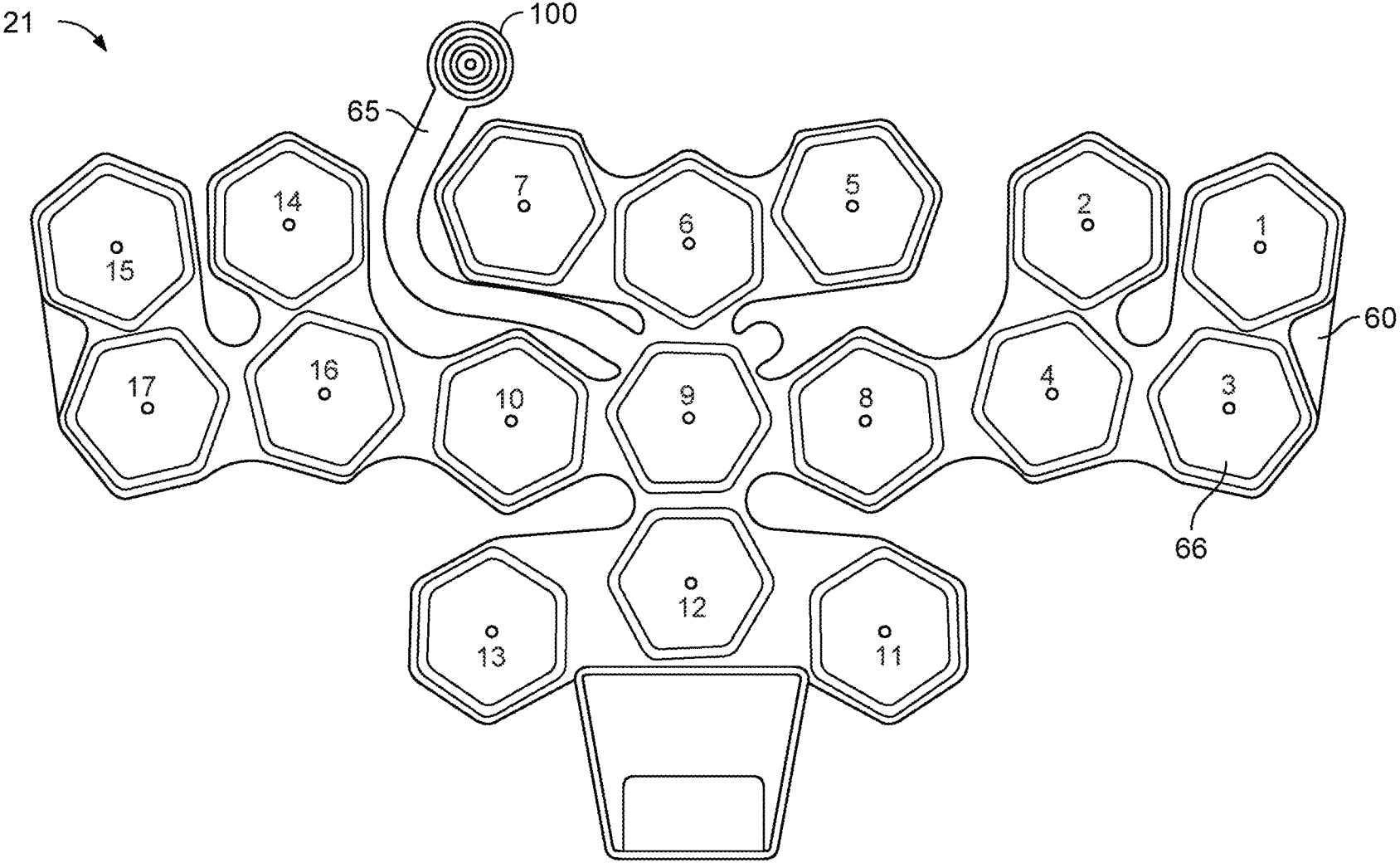
FIG. 30 is a bottom view of a lateral base liner according to a non-limiting embodiment of the subject technology. The numerals on sheet 60 designate index numerals printed on sheet 60, not reference numerals.
Figure 31:
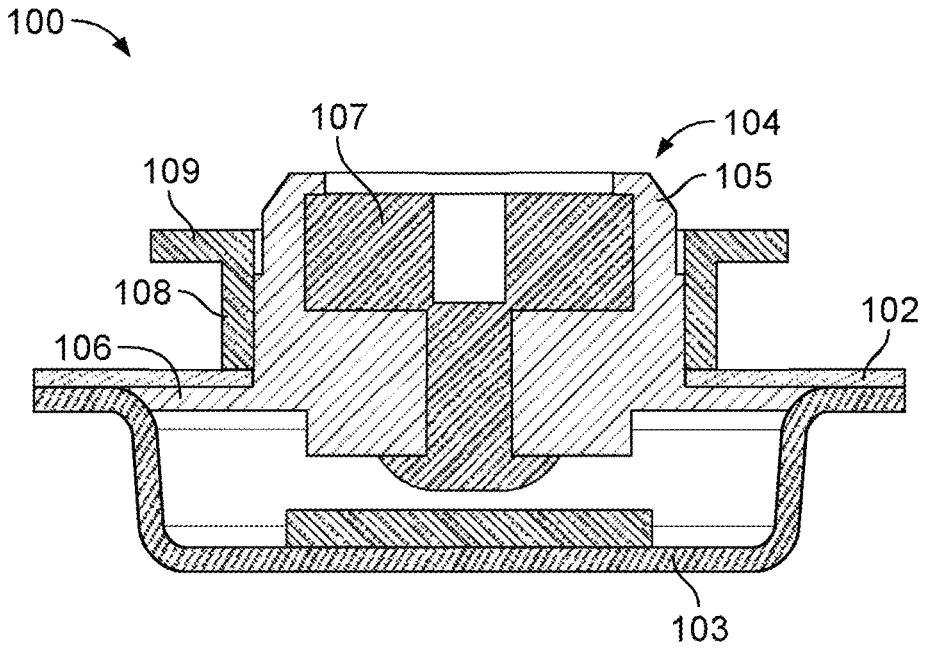
FIG. 31 is a cross-sectional view along the line D-D of a remote valve unit according to a non-limiting embodiment of the subject technology.

On the bottom sheet 60 of the base liners 21, 31, means are disposed for removably attaching fit pods 22, 32, 50. In a non-limiting embodiment, a sheet of hook or loop fabric is bonded to bottom sheet 60, which will mate with the corresponding sheet of hook or loop fabric on the base of fit pods 22, 32, 50. In a non-limiting embodiment, certain attachment sites of the base liners are designated to receive fit pods. As best seen in FIG. 30, attachment sites 66 (only one is numbered) may be demarcated by lines or ridges drawn, printed, inscribed or engraved on the hook/loop fabric attached to the bottom sheet of the base liners. (In FIG. 30, the numerals shown on the attachment cites are not reference numerals, but are index numerals printed on the bottom sheet 60 to uniquely identify each attachment site.) In a non-limiting embodiment, the fit pod attachment sites correspond with cells of the base liners. In a non-limiting embodiment, the fit pod attachment sites tesselate all or part of the bottom sheet 60 of a base liner 21, 31.

In a non-limiting embodiment of the invention, lateral base liner 21 has seventeen fit pod attachment sites and crown base liner 31 has three attachment sites, for a total of twenty pod attachment sites. It will be understood that the fit pods are interchangeable and any pod can be attached at any attachment site. Combined with the six available types of fit pods, billions of fit configurations are possible, providing a high degree of granularity in fitting helmet 10 to any wearer. The number of possible fit configurations of the liner may be calculated as the number of different pod types raised to the power of the number of pod attachment sites on the liner, and in the case of a lateral liner, dividing by two as the lateral pods are in opposition. Thus, the lateral liner according to a non-limiting embodiment having seventeen attachment sites at which any of six different fit pods may be attached to the base lateral liner has approximately $8.463\times10^{12}$ possible fit configurations.

It should be understood that the customizable football helmet described herein is an example of a protective helmet comprising a shell and internal padding disposed within the shell, the internal padding comprising a substrate (in this example, a base liner) having a surface facing the head of the wearer, and fit elements (in this example, fit pods) selected from a set of fit elements, removably attached to the surface of the substrate at selected attachment sites to result in a fit configuration. Preferably the fit elements are interchangeable. Providing a sufficiently large set of different fit elements results in the capability of achieving a number of different fit configurations. In a non-limiting embodiment of the subject technology, the number of possible fit configurations is over one thousand. In a further non-limiting embodiment of the subject technology, the number of possible fit configurations is over ten thousand. In a further non-limiting embodiment of the subject technology, the number of possible fit configurations is over one hundred thousand. In a further non-limiting embodiment of the subject technology, the number of possible fit configurations is over one million. In a further non-limiting embodiment of the subject technology, the number of possible fit configurations is over one billion. In a further non-limiting embodiment of the subject technology, the number of possible fit configurations is over one trillion.

To customize the helmet to the wearer, fit pods are selected from the set and attached to the base liners to result in a custom fit. Preferably, this customization process includes the steps of: (1) providing an initial configuration consisting of a predetermined selection of fit pods attached to predetermined locations on the base liners; (2) determining the fit of the helmet in its present configuration to the wearer; (3) evaluating the fit of the helmet in its present configuration—if it is good enough, the process is complete at this step. If the fit of the helmet in its present configuration is not good enough, continue the process by (4) identifying one or more fit pods to be changed to improve the fit, (5) identifying the changes to be made with respect to those pods (which may be changing to different pods to add or remove height and/or firmness), (6) making the identified changes to the identified fit pods to result in a new present configuration, and returning to step (3), reiterating until the evaluation step results in success.

The steps of this process may be informed by taking anatomical measurements of the wearer's head and analyzing the measurements with respect to the geometry of the helmet (or of a digital avatar of the helmet) to produce a pressure map. What is meant by "pressure map" is a representation of the pressure (either measured or predicted) of the fit pads in a given configuration against the wearer's head. The measurements may be taken by physical contact means or by non-contact means. The fit pods may be selected to optimize a pressure map, and thus optimize the fit, for a given wearer of the helmet. That is, the pressure map may be evaluated to determine which fit pads would press against the head with too much pressure (too tight) or too little pressure (too loose). This information will inform the step of identifying the changes to be made to the fit pods. Too-tight fit pods may be replaced with softer and/or shorter pods; too-loose pods may be replaced with harder and/or taller pods.

The steps of customization may be carried out virtually by predicting the pressures that a given set of fit pads will exert at their respective attachment sites on the wearer's head, given the wearer's head measurements; or practically, by constructing a physical helmet and having the wearer try it on; or a combination of both virtual and practical methods.

In a non-limiting embodiment, anatomical measurements by contact means are taken with the use of an instrumented fitting helmet having internally disposed position and/or pressure sensors at predetermined locations. The sensors may be levers or buttons operably connected to transducers and associated circuitry for collecting position and/or pressure data. The levers or buttons contact the wearer's head, and in cooperation with the transducers and circuitry produce a set of data which represents position and/or pressure data arranged in three dimensions. Preferably, the fitting helmet is constructed using substantially the same shell as the helmet that is being customized. Contact methods may be used which read the actual measurements of the skull, beneath the wearer's hair. The measurements are digitally processed to produce an initial pressure map, which will inform the steps of the fitting process. In another non-limiting embodiment, anatomical measurements by non-contact means are taken by capturing photographic or video images of the wearer's head from various angles, which are digitally processed to create a three-dimensional model or avatar of the wearer's head. Measurements by both contact and non-contact means may be taken and combined. Feedback from the wearer trying the actual helmet on is a good indicator of the wearer's preferences and may also inform the steps of the fitting process.

According to an aspect of the subject technology, the fit pods are easily removed and replaced by an end-user, for example the wearer or by an equipment manager, by hand and without any special expertise or tools. This aspect of the technology enables easy resizing of a helmet in the field or equipment room, whenever desired. For example, a change in a wearer's hair style may cause the helmet to fit differently. As another example, a player may discover in use of the helmet that it is fitting too tightly or too loosely in certain places. As another example, the helmet may be given to a different player to wear. All these situations are easily addressed by changing out the fit pods. Optionally, the full process of fitting the helmet using contact and/or non-contact measurements and pressure map analysis may be repeated in a given situation, or a player/manager may simply remove a fit pod and replace it with another to get a better fit. It will be appreciated that this feature also enables replacement of a worn or damaged fit pod, without reconditioning the entire helmet. Thus, the subject technology includes a kit consisting of a set of various fit pods as described herein for end-user reconfiguration of a custom helmet. The subject technology also includes a kit consisting of a helmet as described herein, with or without installed fit pods, together with a set of various fit pods as described herein for end-user reconfiguration of the helmet.

According to an additional aspect of the subject technology, all cells or certain cells of a base liner are inflatable, which provides an additional means of making fine adjustments to the fit of the helmet. In the non-limiting embodiment of the Figures, a central row and a top row of cells of the lateral base liner are inflatable, while the remaining cells of the lateral liner, and all the cells of the crown base liner, are non-inflatable.

In a non-limiting embodiment, an air liner of a helmet is inflatable through a remote valve disposed on an inner surface of the helmet shell and connected to the air liner through a tube. As seen for example in the non-limiting embodiments of FIGS. 11-12 and 29-30, a cell of base lateral liner 21 is provided with a passage 64. Passage 64 is preferably lying in the same plane as the liner. Tube 65 for the passage of air is fitted to a mouth of passage 64, the fitting itself being air-tight. Tube 65 extends to a remote valve unit for inflation of the inflatable cells of liner 21. By use of this structure, the inflation hole through the shell may be provided in any convenient place in the shell and need not be located in superposition with air liner 21. Additionally, liner 21, and any shock absorbing padding between liner 21 and shell 10, do not require any provision for a valve directly attached to a cell of liner 21 and extending out of the plane of liner 21, and through the shock absorbing padding. This results in a low-profile liner structure, which is especially advantageous in the subject technology, for providing a stable base for building up the custom liner using the custom fit pods, despite the inclusion of shock-absorbing elements in the base liner cells.

In a further non-limiting aspect of the subject technology, as best seen in FIGS. 19-27 and 31, a remote valve unit 100 comprises a valve cell 101 comprising top portion 102 and bottom portion 103, both of non-porous polymer material which may be TPU or PVC material, for example. Top portion 102 and bottom portion 103 are sealed to form an airtight seam as in the liner. Preferably, valve cell 101 does not contain a pad of foam or other shock absorbing material. Extensions of portions 102, 103 are sealed to form a passage 110, which is sealed in an air-tight manner to tube 65 for inflation and deflation of the connected air liner.

Valve assembly 104 is installed in an opening formed in top portion 102 and is bonded to form an airtight seal with top portion 102. Valve assembly 104 has a flanged housing 105 with flange 106. Housing 105 contains valve 107 and is disposed within flanged collar 108 having flange 109. Preferably, collar 108 is permanently bonded to housing 105. Flange 106 has a larger diameter than flange 109. All the foregoing parts may be made of molded polymer material. Valve 107 may be a conventional needle valve as known in the art.

A mounting hole or keyway 120 is formed in shell 10 for mounting of remote valve unit 100. For ease of assembly, hole 120 is formed to have a large opening 121 conjoined with small opening 122. Large opening 121 is large enough to admit the flange 109 of collar 108 but not large enough to admit flange 106. Small opening 122 is large enough to admit the body of collar 108 but not the flanges 106, 109. A chord at the joinder line of the openings 121, 122 provides enough clearance for the body of collar 108 to snap into and out of opening 122. The remote valve unit 100 is assembled to shell 10 by inserting collar 108 through the large opening 121, and then snapping it into the small opening 122, where it resides. The flanges 106, 109 are thus disposed against the inner surface and outer surface, respectively, of shell 10. Stated another way, flanges 106, 109 define between them a groove in which the surrounding portion of shell 10 resides. Flanges 106, 109 stabilize the remote valve unit 100 with respect to the helmet shell 10, so it does not substantially move during sports play, or when a needle is inserted into valve 107 for inflation or deflation of the attached air liner. Remote valve unit 100 does not require other means, such as hook-and-loop fasteners, to maintain its location on shell 10.

Figure 28:
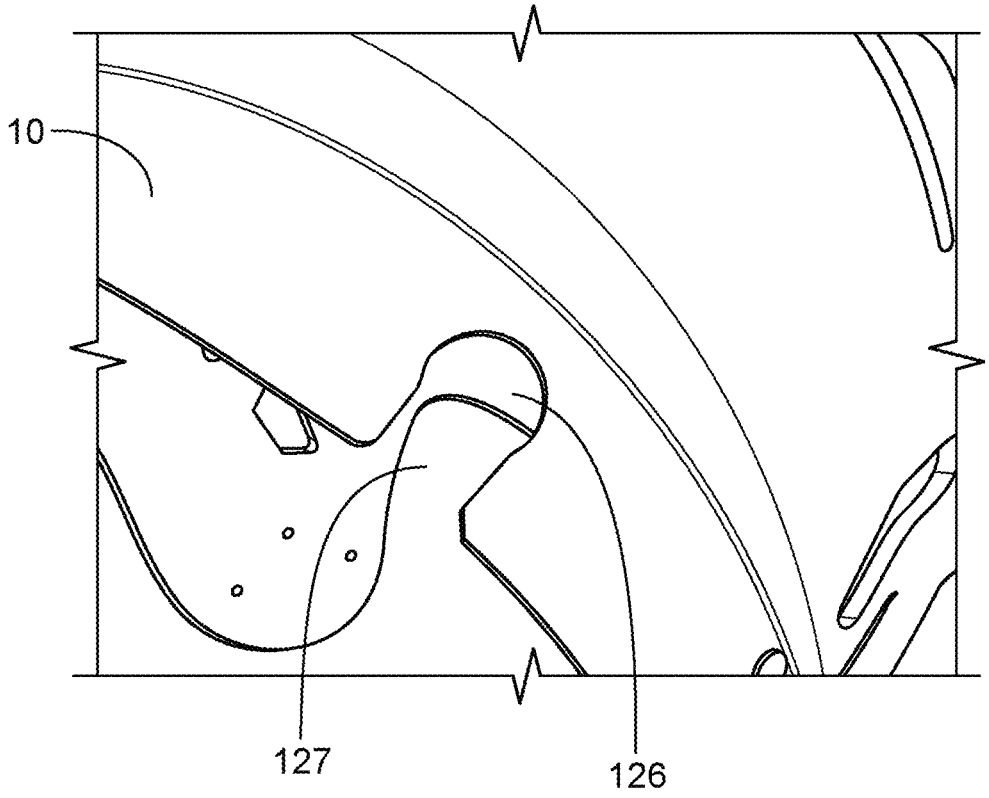
FIG. 28 is a rear detail view of a football helmet shell according to a non-limiting embodiment of the subject technology showing a valve mounting hole in the shell.
Figure 29:
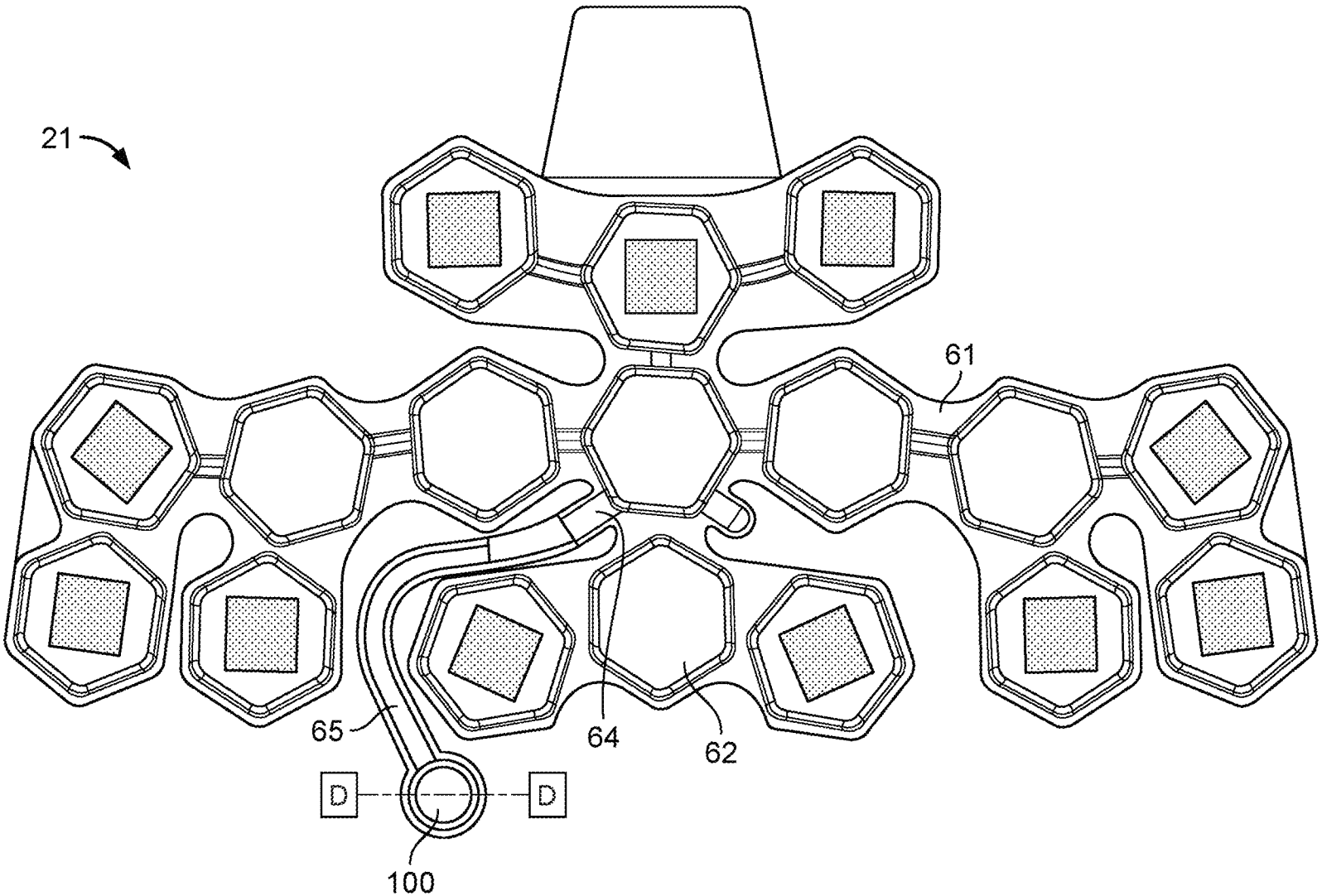
FIG. 29 is a plan view of a lateral base liner according to a non-limiting embodiment of the subject technology.

FIG. 28 shows another embodiment in which shell 10 has opening 126 formed therethrough, which is connected to the periphery of shell 10 by passage 127. Opening 126 and passage 127 are large enough to admit the body of collar 108 but not the flanges 106, 109. In this embodiment, the remote valve unit 100 is assembled to shell 10 by sliding collar 108 through passage 127 and into opening 126 where it resides.

A neck bumper 125 may be installed on shell 10, disposed on the lower edge of the rear area of shell 10, and a hole formed in the neck bumper 125 to expose valve 107 and receive a protruding portion of housing 105, such that flange 109 is disposed between bumper 125 and shell 10. Thus, the neck bumper 125 further stabilizes the remote valve unit 100 in its location. Neck bumper 125 also covers large opening 121.

In embodiments of the subject technology which are sports helmets including football helmets, it is preferable that the helmet is NOCSAE-certified and that any attached face guard is NOCSAE-certified. Thus, it is a feature of the subject technology that the materials and structures used in the helmet and all components are adapted to be suitable for use in the relevant sport, for example the sport of football.

It should be understood that the claimed invention is not limited to any particular method of selecting and/or configuring the fit pods unless so specified in the recitations of a claim.

A commercial embodiment of the subject technology is the Schutt F7 UR1 football helmet, which is a product of Schutt Sports, the applicant/assignee of this application.

While a specific embodiment of the subject technology has been shown and described in detail to illustrate the application of the principles of the subject technology, it will be understood that the subject technology may be embodied otherwise without departing from such principles. It will also be understood that the present subject technology includes any combination of the features and elements disclosed herein and any combination of equivalent features. The exemplary embodiments shown herein are presented for the purposes of illustration only and are not meant to limit the scope of the subject technology.

What is claimed is:

1. A helmet kit comprising:

a helmet shell adapted to protect a head of a wearer, the helmet shell including a first internal area and a second internal area that are spaced apart therein;

an internal padding structure comprising a first liner pad and a second liner pad, the first liner pad configured to layer over the first internal area and the second liner pad configured to layer over the second internal area, the first liner pad including a first surface with a first demarcation corresponding to a first pod site facing the head of the wearer when disposed within the helmet shell, the second liner pad including a second surface with a second demarcation corresponding to a second pod site facing the head of the wearer when disposed within the helmet shell, wherein at least one of the first demarcation and the second demarcation is an alphanumeric symbol; and a plurality of fit pods including a first fit pod and a second fit pod removably attachable within the helmet shell with the internal padding structure layered between the helmet shell and the plurality of fit pods, the first fit pod layered upon the first pod site and the second fit pod layered upon the second pod site in a customized fit configuration.

2. The helmet kit of claim 1, wherein at least one of the first internal area and the second internal area defines a lateral area of the helmet shell configured to cover a lateral portion of the head of the wearer.

3. The helmet kit of claim 1, wherein at least one of the first demarcation and the second demarcation comprises a line extending along the respective one of the first surface and the second surface.

4. The helmet kit of claim 3, wherein the line is inscribed in the respective one of the first surface and the second surface.

5. The helmet kit of claim 1, wherein the first liner pad comprises thermoplastic urethane (TPU) material.

6. The helmet kit of claim 5, wherein the first fit pod comprises a vinyl material.

7. The helmet kit of claim 1, wherein the internal padding structure is removably attached within the helmet shell and customizable according to the head of the wearer.

8. The helmet kit of claim 1, wherein the first fit pod is one of a plurality of first fit pods arranged in a first set, the plurality of first fit pods being interchangeable for the helmet kit, and wherein the first fit pod is chosen from the first set for providing the customized fit configuration.

9. The helmet kit of claim 1, wherein the first liner pad includes a bottom sheet and a top sheet that is attached to the bottom sheet to cooperatively define a cell therebetween, the first liner pad including a liner pad that is received within the cell.

10. A helmet kit comprising:

a helmet shell adapted to protect a head of a wearer, the helmet shell including a first internal area and a second internal area that are spaced apart therein;

an internal padding structure comprising a first liner pad and a second liner pad, wherein the internal padding structure is removably attached within the helmet shell and customizable according to the head of the wearer, the first liner pad configured to layer over the first internal area and the second liner pad configured to layer over the second internal area, the first liner pad including a first surface with a first demarcation corresponding to a first pod site facing the head of the wearer when disposed within the helmet shell, the second liner pad including a second surface with a second demarcation corresponding to a second pod site facing the head of the wearer when disposed within the helmet shell; and a plurality of fit pods including a first fit pod and a second fit pod removably attachable within the helmet shell with the internal padding structure layered between the helmet shell and the plurality of fit pods, the first fit pod layered upon the first pod site and the second fit pod layered upon the second pod site in a customized fit configuration.

11. The helmet kit of claim 10, wherein at least one of the first liner pad and the second liner pad includes an inflatable structure, the inflatable structure having an adjustable internal pressure for customizing fit of the helmet kit to the head of the wearer.

12. The helmet kit of claim 10, wherein the first fit pod is one of a plurality of first fit pods arranged in a first set, the plurality of first fit pods being interchangeable for the helmet kit, and wherein the first fit pod is chosen from the first set for providing the customized fit configuration.

13. The helmet kit of claim 12, wherein individual ones of the plurality of first fit pods differ in at least one characteristic chosen from a group consisting of: height, width, shape, size, cross-section, material, thickness, stiffness, firmness, density and hardness.

14. The helmet kit of claim 10, wherein the first liner pad includes a bottom sheet and a top sheet that is attached to the bottom sheet to cooperatively define a cell therebetween, the first liner pad including a liner pad that is received within the cell.

15. A helmet kit comprising:

a helmet shell adapted to protect a head of a wearer, the helmet shell including a first internal area and a second internal area that are spaced apart therein;

a helmet liner system adapted for providing a customized fit configuration according to the head of the wearer, the helmet liner system comprising:

an internal padding structure comprising a first liner pad and a second liner pad, wherein the internal padding structure is removably attached within the helmet shell and customizable according to the head of the wearer, the first liner pad configured to layer over the first internal area and the second liner pad configured to layer over the second internal area, the first liner pad including a first surface with a first demarcation corresponding to a first pod site facing the head of the wearer when disposed within the helmet shell, the second liner pad including a second surface with a second demarcation corresponding to a second pod site facing the head of the wearer when disposed within the helmet shell; and a plurality of fit pods including a first fit pod and a second fit pod removably attachable within the helmet shell with the internal padding structure layered between the helmet shell and the plurality of fit pods, the first fit pod layered upon the first pod site and the second fit pod layered upon the second pod site in the customized fit configuration.

16. The helmet kit of claim 15, wherein at least one of the first internal area and the second internal area defines a lateral area of the helmet shell configured to cover a lateral portion of the head of the wearer.

17. The helmet kit of claim 15, wherein the first liner pad includes a bottom sheet and a top sheet that is attached to the bottom sheet to cooperatively define a cell therebetween, the first liner pad including a liner pad that is received within the cell.

18. The helmet kit of claim 15, wherein at least one of the first demarcation and the second demarcation comprises a line inscribed into the respective one of the first surface and the second surface.

19. The helmet kit of claim 15, wherein at least one of the first liner pad and the second liner pad includes an inflatable structure, the inflatable structure having an adjustable internal pressure for customizing fit of the helmet kit to the head of the wearer.

20. The helmet kit of claim 15, wherein the first fit pod is one of a plurality of first fit pods arranged in a first set, the plurality of first fit pods being interchangeable for the helmet kit, and wherein the first fit pod is chosen from the first set for providing the customized fit configuration.

* * * * *